US010784579B2

(12) United States Patent
You et al.

(10) Patent No.: US 10,784,579 B2
(45) Date of Patent: Sep. 22, 2020

(54) ULTRA-WIDEBAND CTS FLAT-PLATE ARRAY ANTENNA

(71) Applicant: Ningbo University, Zhejiang (CN)

(72) Inventors: Qingchun You, Zhejiang (CN); Jifu Huang, Zhejiang (CN); Liting Qin, Zhejiang (CN); Yang You, Zhejiang (CN)

(73) Assignee: Ningbo University, Zhejiang (CN)

( * ) Notice: Subject to any disclaimer, the term of this patent is extended or adjusted under 35 U.S.C. 154(b) by 7 days.

(21) Appl. No.: 16/416,297

(22) Filed: May 20, 2019

(65) Prior Publication Data

US 2020/0014107 A1 Jan. 9, 2020

(30) Foreign Application Priority Data

Jul. 9, 2018 (CN) ..... 2018 1 0742462

(51) Int. Cl.

| | |
|---|---|
| ***H01Q 5/25*** | (2015.01) |
| ***H01P 3/123*** | (2006.01) |
| ***H01P 5/16*** | (2006.01) |
| ***H01Q 21/00*** | (2006.01) |

(52) U.S. Cl.

CPC ..... *H01Q 5/25* (2015.01); *H01P 3/123* (2013.01); *H01P 5/16* (2013.01); *H01Q 21/0006* (2013.01)

(58) Field of Classification Search

CPC ..... H01Q 5/25; H01Q 7/02; H01Q 13/065; H01Q 5/342; H01Q 5/28; H01Q 21/0006; H01Q 13/10; H01Q 13/106; H01Q 13/18; H01P 3/123; H01P 5/16

USPC ..... 343/786, 700 MS, 702, 772, 911 R, 767

See application file for complete search history.

(56) References Cited

U.S. PATENT DOCUMENTS

2012/0007783 A1* 1/2012 Taura ..... H01Q 1/2266 343/702

FOREIGN PATENT DOCUMENTS

CN 106887716 6/2017

* cited by examiner

*Primary Examiner* — Wei (Victor) Y Chan

(74) *Attorney, Agent, or Firm* — JCIPRNET

(57) ABSTRACT

An ultra-wideband CTS flat-plate array antenna includes a radiating layer, a mode switching layer and a feed network layer sequentially arrayed from top to bottom. The mode switching layer comprises a first metal plate and a mode switching cavity formed in the first metal plate and including two mode switching units which are arranged left and right and each includes eight H-plane Y-type single-ridge waveguide power dividers arrayed in 4 rows and 2 columns. The H-plane Y-type single-ridge waveguide power divider in the $m^{th}$ row and $1^{st}$ column is bilaterally symmetrical with the H-plane Y-type single-ridge waveguide power divider in the $m^{th}$ row and $2^{nd}$ column. The two H-plane Y-type single-ridge waveguide power dividers in the each row are connected through an E-plane T-type single-ridge waveguide power divider. A center distance between every two adjacent H-plane Y-type single-ridge waveguide power dividers in each column is not over one wavelength.

6 Claims, 7 Drawing Sheets

ULTRA-WIDEBAND CTS FLAT-PLATE ARRAY ANTENNA

CROSS-REFERENCE TO RELATED APPLICATION

This application claims the priority benefits of Chinese application serial No. 201810742462.9, filed on Jul. 9, 2018. The entirety of the above-mentioned patent application is hereby incorporated by reference herein and made a part of specification.

BACKGROUND

Technical Field

The invention relates to an array antenna, in particular to an ultra-wideband CTS flat-plate array antenna.

Description of Related Art

In recent years, high-sensitivity, wideband and low-profile high-performance flat-plate antennas with the characteristics of multi-band frequency and low cost have been widely used in the fields of wireless communications, ultra-wideband communications, satellite communications and the like. In 1990, the American Hughes Corporation invented a continuous transverse stub (CTS) flat-plate array antenna which adopts the TEM mode for feeding and is formed by parallel-plate waveguides provided with tangent slots. Longitudinal current components generated by the parallel-plate waveguides excited by any plane waves will be cut off by horizontal slots, longitudinal displacement currents are generated at the junction of the slots and the parallel-plate waveguides, and at this moment, energy transmitted in the parallel-plate waveguides is coupled through continuous transverse stubs, and electromagnetic waves are radiated to the outside. Compared with other flat-plate array antennas, this CTS flat-plate array antenna has the characteristics of low standing waves, high efficiency, low profile, low cost, insensitivity to fabrication precision and the like.

Existing CTS flat-plate array antennas typically comprise a radiating unit, a planar waveguide power dividing network and a mode switcher used for quasi-TEM mode signals, wherein the radiating unit is formed by E-plane step horns and is used for radiating a plurality of paths of signals into a free space, the planar waveguide power dividing network is formed by a plurality of stages of bisected E-plane planar waveguide power dividers and is used for dividing one path of input signals into multiple paths of signals, and the mode switcher for quasi-TEM mode signals is used for switching a single path of TE10 mode waves fed via a standard waveguide port into quasi-TEM mode waves.

Chinese Invention Patent Application No. 201710030209.6 discloses a CTS flat-plate array antenna which comprises a polarization layer, a radiating layer, a mode switching layer and a feed network layer, wherein the mode switching layer comprises a substrate and a mode switching cavity array disposed on the substrate. Each mode switching cavity is a one-four constant-amplitude in-phase power divider formed by a traditional rectangular waveguide. The feed network layer is used for switching a single path of TE10 mode signals fed via a standard waveguide port into multiple paths of same-power in-phase TE10 mode signals, and each path of TE10 mode signals can generate constant-amplitude in-phase plane waves after passing through the corresponding mode switching cavity. Due to the facts that the traditional rectangular waveguides have a narrow relative bandwidth and the one-four constant-amplitude in-phase power dividers forming the traditional rectangular waveguides also have a narrow relative bandwidth and are difficult to match, the relative bandwidth of the mode switching cavities is generally about 20%, which limits the relative bandwidth of the whole CTS flat-plate array antenna. The relative bandwidth of the CTS flat-plate array antenna is only 19.1% when the return loss is lower than 16 dB.

SUMMARY

The technical issue to be settled by the invention is to provide an ultra-wideband CTS flat-plate array antenna having a wide relative bandwidth.

The technical solution is adopted by the invention to settle the above technical issue is as follows: an ultra-wideband CTS flat-plate array antenna comprises a radiating layer, a mode switching layer and a feed network layer which are sequentially arrayed from top to bottom. The mode switching layer comprises a first metal plate and a mode switching cavity formed in the first metal plate, and the mode switching cavity comprises two mode switching units which are identical in structure and are arranged left and right in a spaced manner. Each mode switching unit comprises eight H-plane Y-type single-ridge waveguide power dividers which are arrayed in 4 rows and 2 columns, wherein the H-plane Y-type single-ridge waveguide power divider in the $m^{th}$ row and $1^{st}$ column is bilaterally symmetrical with the H-plane Y-type single-ridge waveguide power divider in the $m^{th}$ row and $2^{nd}$ column, and m=1, 2, 3 and 4. The two H-plane Y-type single-ridge waveguide power dividers in each row are connected through an E-plane T-type single-ridge waveguide power divider, and a center distance between every two adjacent H-plane Y-type single-ridge waveguide power dividers in each column is not over one wavelength. The H-plane Y-type single-ridge waveguide power divider in the $m^{th}$ row and $1^{st}$ column comprises a first rectangular cavity, an isosceles-trapezoid cavity, a second rectangular cavity, a third rectangular cavity, a fourth rectangular cavity and a fifth rectangular cavity which are sequentially formed in an upper end face of the first metal plate from right to left, the first rectangular cavity, the isosceles-trapezoid cavity, the second rectangular cavity, the third rectangular cavity, the fourth rectangular cavity and the fifth rectangular cavity are sequentially communicated front and back, are identical in height and are lower than the first metal plate, and center lines of the first rectangular cavity, the isosceles-trapezoid cavity, the second rectangular cavity, the third rectangular cavity, the fourth rectangular cavity and the fifth rectangular cavity in a front-back direction are located on the same straight line. A length direction of the first rectangular cavity, the second rectangular cavity, the third rectangular cavity, the fourth rectangular cavity and the fifth rectangular cavity is defined as a front-back direction of the first metal plate, and a width direction of the first rectangular cavity, the second rectangular cavity, the third rectangular cavity, the fourth rectangular cavity and the fifth rectangular cavity is defined as a left-right direction of the first metal plate. A right end face of the isosceles-trapezoid cavity is parallel to a left end face of the isosceles-trapezoid cavity and is smaller than the left end face of the isosceles-trapezoid cavity in size, and a front end face of the isosceles-trapezoid cavity is equal to a rear end face of the isosceles-trapezoid cavity. A right end face of the first rectangular cavity is flush with the left end face of the isosceles-trapezoid cavity, a length of the first rectangular cavity is smaller than that of the right end face of the isosceles-trapezoid cavity in the front-back direction of the first metal plate, the left end face of the isosceles-trapezoid cavity overlaps a right end face of the second rectangular cavity and is as large as the right end face of the second rectangular cavity, a left end face of the second rectangular cavity is flush with a right end face of the third rectangular cavity, a length of the third rectangular cavity is greater than that of the second rectangular cavity, a left end face of the third rectangular cavity is flush with a right end face of the fourth rectangular cavity, a length of the fourth rectangular cavity is greater than that of the third rectangular cavity, a left end face of the fourth rectangular cavity is flush with a right end face of the fifth rectangular cavity, and a length of the fifth rectangular cavity is greater than that of the fourth rectangular cavity; a first rectangular metal ridge is arranged in the first rectangular cavity, a right end face of the first rectangular metal ridge is flush with the right end face of the first rectangular cavity, a left end face of the first rectangular metal ridge is flush with a left end face of the first rectangular cavity, a height of the first rectangular metal ridge is half that of the first rectangular cavity, a length of the first rectangular metal ridge in the front-back direction of the first metal plate is smaller than a quarter of the length of the first rectangular cavity, and a distance between a front end face of the first rectangular metal ridge and a front end face of the first rectangular cavity is equal to a distance between a rear end face of the first rectangular metal ridge and a rear end face of the first rectangular cavity. A first rectangular metal base plate and a second rectangular metal ridge are arranged in the isosceles-trapezoid cavity, a height of the first rectangular metal base plate is smaller than a quarter of a height of the isosceles-trapezoid cavity, a right end face of the first rectangular metal base plate is flush with the right end face of the isosceles-trapezoid cavity, a left end face of the first rectangular metal base plate is located in the second rectangular cavity, a length of the first rectangular metal base plate in the front-back direction of the first metal plate is greater than that of the first rectangular cavity and is smaller than that of the right end face of the isosceles-trapezoid cavity in the front-back direction of the first metal base plate, a distance between a front end face of the first rectangular metal base plate and a front end face of the second rectangular cavity is equal to a distance between a rear end face of the first rectangular metal base plate and a rear end face of the second rectangular cavity, a lower end face of the second rectangular metal ridge is attached to a upper end face of the first rectangular metal base plate, a right end face of the second rectangular metal ridge is flush with the left end face of the first rectangular metal ridge, an upper end face of the second rectangular metal ridge and an upper end face of the first rectangular metal ridge are located on the same plane, a length of the second rectangular metal ridge in the left-right direction of the first metal plate is not greater than a quarter of a length of the isosceles-trapezoid cavity in the left-right direction of the first metal plate. A first metal cylinder is arranged on the first rectangular metal base plate, a lower end face of the first metal cylinder is attached to the upper end face of the first rectangular metal base plate, a center of the first metal cylinder is located on a center line of the upper end face of the first rectangular metal base plate in the left-right direction of the first metal plate and is also located on the left end face of the isosceles-trapezoid cavity, a diameter of the first metal cylinder is smaller than a width of the first rectangular metal ridge and is greater than 0.5 mm, and a height of the first metal cylinder is smaller than a quarter of the height of the isosceles-trapezoid cavity. A first rectangular metal baffle is arranged in the second rectangular cavity, a right end face of the first rectangular metal baffle is flush with the left end face of the first rectangular metal base plate, a left end face of the first rectangular metal baffle is flush with the left end face of the second rectangular cavity, a length of the first rectangular metal baffle in the front-back direction of the first metal plate is smaller than that of the first rectangular metal base plate in the front-back direction of the first metal plate and is greater than that of the first rectangular metal ridge in the front-back direction of the first metal plate, the length of the first rectangular metal baffle in the left-right direction of the first metal plate is smaller than half of a width of the second rectangular cavity, a height of the first rectangular metal baffle is equal to that of the second rectangular cavity, and a distance between a front end face of the first rectangular metal baffle and the front end face of the second rectangular cavity is equal to a distance between a rear end face of the first rectangular metal baffle and the rear end face of the second rectangular cavity. A second rectangular metal baffle is arranged in the third rectangular cavity, a right end face of the second rectangular metal baffle is flush with the right end face of the first rectangular metal baffle, a left end face of the second rectangular metal baffle is flush with the left end face of the third rectangular cavity, a length of the second rectangular metal baffle in the front-back direction of the first metal plate is smaller than that of the first rectangular metal baffle in the front-back direction of the first metal plate and is greater than half that of the first rectangular metal baffle in the front-back direction of the first metal plate, a height of the second rectangular metal baffle is equal to that of the third rectangular cavity, and a distance between a front end face of the second rectangular metal baffle and a front end face of the third rectangular cavity is equal to a distance between a rear end face of the second rectangular metal baffle and a rear end face of the third rectangular cavity. A third rectangular metal baffle is arranged in the fourth rectangular cavity, a right end face of the third rectangular metal baffle is flush with the rear end face of the second rectangular metal baffle, a left end face of the third rectangular metal baffle is flush with the left end face of the fourth rectangular cavity, a height of the third rectangular metal baffle is equal to that of the fourth rectangular cavity, a length of the third rectangular metal baffle in the front-back direction of the first metal plate is smaller than the diameter of the first metal cylinder and is greater than 0.5 mm, a distance between a front end face of the third rectangular metal baffle and a front end face of the fourth rectangular cavity is equal to a distance between a rear end face of the third rectangular metal baffle and a rear end face of the fourth rectangular cavity, a second metal cylinder is arranged in the fifth rectangular cavity, a diameter of the second metal cylinder is equal to that of the first metal cylinder, a height of the second metal cylinder is smaller than half that of the fifth rectangular cavity, and a center of the second metal cylinder and a center of the fifth rectangular cavity are located on the same straight line. The H-plane Y-type single-ridge waveguide power divider further comprises a first ridge assembly and a second ridge assembly which are symmetrically arranged in the front-back direction of the first metal plate, and the first ridge assembly comprises a first right-trapezoid metal block, a second right-trapezoid metal block, a first rectangular metal block, a second rectangular metal block, a third rectangular metal block and a fourth rectangular metal block. The first rectangular metal block is located on the first rectangular metal base plate, a lower end face of the first rectangular metal block is attached to the upper end face of the first rectangular metal base plate, a front end face of the first rectangular metal block is flush with the front end face of the first rectangular metal base plate, a length of the first rectangular metal block in the front-back direction of the first metal plate is smaller than one tenth of the length of the first rectangular metal base plate in the front-back direction of the first metal plate, the length of the first rectangular metal block in the left-right direction of the first metal plate is equal to that of the first rectangular metal ridge in the front-back direction of the first metal plate, a sum of a height of the first rectangular metal block and the height of the first rectangular metal base plate is equal to the height of the first rectangular metal ridge, and a distance between a right end face of the first rectangular metal block and the right end face of the first rectangular metal base plate is equal to a distance between a left end face of the first rectangular metal block and the left end face of the first rectangular metal base plate. The first right-trapezoid metal block and the second right-trapezoid metal block are located in the isosceles-trapezoid cavity, the first right-trapezoid metal block is located in front of the first rectangular metal block, a left end face of the first right-trapezoid metal block is parallel to a right end face of the first right-trapezoid metal block, the right end face of the first right-trapezoid metal block is smaller than the left end face of the first right-trapezoid metal block, a rear end face of the first right-trapezoid metal block, the front end face of the first rectangular metal base plate and the front end face of the first rectangular metal block are connected and are located on the same plane, a front end face of the first right-trapezoid metal block is parallel to the front end face of the isosceles-trapezoid cavity, a height of the first right-trapezoid metal block is equal to that of the first rectangular metal ridge, a lower end face of the first right-trapezoid metal block is attached to a lower end face of the isosceles-trapezoid cavity, the second right-trapezoid metal block is located on a left side of the first right-trapezoid metal block, a right end face of the second right-trapezoid metal block and the left end face of the first right-trapezoid metal block are connected and are located on the same plane, a left end face of the second right-trapezoid metal block is parallel to the right end face of the second right-trapezoid metal block, the right end face of the second right-trapezoid metal block is smaller than the left end face of the second right-trapezoid metal block, a front end face of the second right-trapezoid metal block and the front end face of the first right-trapezoid metal block are connected and are located on the same plane, a length of the left end face of the second right-trapezoid metal block in the front-back direction of the first metal plate is equal to that of the first right-trapezoid metal block in the left-right direction of the first metal plate, a height of the second right-trapezoid metal block is equal to that of the first rectangular metal ridge, and a lower end face of the second right-trapezoid metal block is attached to the lower end face of the isosceles-trapezoid cavity. A right end face of the second rectangular metal block overlaps the left end face of the second right-trapezoid metal block, a left end face of the second rectangular metal block is located in the third rectangular cavity, a distance between a front end face of the second rectangular metal block and the front end face of the second rectangular cavity is equal to a distance between a rear end face of the second rectangular metal block and the front end face of the second rectangular metal baffle, a height of the second rectangular metal block is equal to that of the first rectangular metal ridge, a length of a part, located in the third rectangular cavity, of the second rectangular metal block in the left-right direction of the first metal plate is not greater than one third of a width of the third rectangular cavity, and a lower end face of the second rectangular metal block is attached to a lower end face of the second rectangular cavity and a lower end face of the third rectangular cavity. A right end face of the third rectangular metal block overlaps a left end face of the second rectangular block, a left end face of the third rectangular metal block is located in the fourth rectangular cavity, a length of a part, located in the fourth rectangular cavity, of the third rectangular metal block in the left-right direction of the first metal plate is not greater than one fifth of the width of the fourth rectangular cavity, and a height of the third rectangular metal block is smaller than that of the second rectangular metal block and is greater than half that of the second rectangular metal block. A right end face of the fourth rectangular metal block overlaps the left end face of the third rectangular metal block, a rear end face of the fourth rectangular metal block is located in the fifth rectangular cavity, and a length of a part, located in the fifth rectangular cavity, of the fourth rectangular metal block in the left-right direction of the first metal plate is greater than half of a width of the fifth rectangular cavity, and a height of the fourth rectangular metal block is smaller than that of the third rectangular metal block and is greater than half that of the third rectangular metal block.

The E-plane T-type single-ridge waveguide power divider comprises a fifth rectangular metal block, wherein a sixth rectangular cavity, a seventh rectangular cavity and an eighth rectangular cavity are sequentially formed in an upper surface of the fifth rectangular metal block from left to right, and the sixth rectangular cavity, the seventh rectangular cavity and the eighth rectangular cavity are sequentially communicated, are identical in height and are as high as the first rectangular cavity. A center line of the sixth rectangular cavity in the left-right direction, a center line of the seventh rectangular cavity in the left-right direction and a center line of the eighth rectangular cavity in the left-right direction are located on the same straight line, a left end face of the sixth rectangular cavity is located on the left end face of the fifth rectangular metal block, a right end face of the sixth rectangular cavity is flush with a left end face of the seventh rectangular cavity, a right end face of the seventh rectangular cavity is flush with a left end face of the eighth rectangular cavity, a right end face of the eighth rectangular cavity is located on a right end face of the fifth rectangular metal block, a rectangular waveguide port is formed below the seventh rectangular cavity, an upper end face of the rectangular waveguide port overlaps a lower end face of seventh rectangular cavity, a lower end face of the rectangular waveguide port is located on a lower end face of the fifth rectangular metal block, a length of the sixth rectangular cavity in the front-back direction and a length of the eighth rectangular cavity in the front-back direction are equal to the length of the first rectangular cavity, the length of the sixth rectangular cavity in the front-back direction is smaller than that of the seventh rectangular cavity in the front-back direction, a third rectangular metal ridge is arranged in the sixth rectangular cavity, a height of the third rectangular metal ridge is smaller than half that of the sixth rectangular cavity, a length of the third rectangular metal ridge in the front-back direction is smaller than half that of the sixth rectangular cavity in the front-back direction, a distance between a front end face of the third rectangular metal ridge and a front end face of the sixth rectangular cavity is equal to a distance between a rear end face of the third rectangular metal ridge and a rear end face of the sixth rectangular cavity, a left end face of the third rectangular metal ridge is flush with the left end face of the sixth rectangular cavity, and a right end face of the third rectangular metal ridge is flush with the right end face of the sixth rectangular cavity. A fourth rectangular metal ridge is arranged in the eighth rectangular cavity, a height of the fourth rectangular metal ridge is smaller than half that of the eighth rectangular cavity, a length of the fourth rectangular metal ridge in the front-back direction is smaller than half that of the eighth rectangular cavity in the front-back direction, a distance between a front end face of the fourth rectangular metal ridge and a front end face of the eighth rectangular cavity is equal to a distance between a rear end face of the fourth rectangular metal ridge and a rear end face of the eighth rectangular cavity, a left end face of the fourth rectangular metal ridge is flush with the left end face of the eighth rectangular cavity, and a right end face of the fourth rectangular metal ridge is flush with the right end face of the eighth rectangular cavity. A first H-plane step and a second H-plane step are arranged in the seventh rectangular cavity, the first H-plane step is located above the second H-plane step, the first H-plane step and the second H-plane step are both rectangular, an upper end face of the first H-plane step is flush with an upper end face of the seventh rectangular cavity, a lower end face of the first H-plane step is attached to an upper end face of the second H-plane step, a left end face of the first H-plane step is attached to the left end face of the seventh rectangular cavity, a right end face of the first H-plane step is attached to the right end face of the seventh rectangular cavity, a front end face of the first H-plane step is attached to a front end face of the seventh rectangular cavity, a rear end face of the first H-plane step is attached to a rear end face of the seventh rectangular cavity, a rear end face of the second H-plane step is connected with the rear end face of the seventh rectangular cavity, a front end face of the second H-plane step is connected with the front end face of the seventh rectangular cavity, a length of the second H-plane step in the left-right direction is smaller than that of the seventh rectangular cavity in the left-right direction, a distance between a left end face of the second H-plane step and the left end face of the seventh rectangular cavity is equal to a distance between a right end face of the second H-plane step and the right end face of the seventh rectangular cavity, a height of the second H-plane step is greater than that of the first H-plane step, and the height of the second H-plane step is smaller than a quarter of a height of the seventh rectangular cavity. When two H-plane Y-type single-ridge waveguide power dividers in each row are connected with one E-plane T-type single-ridge waveguide power divider, the right end face of the first rectangular cavity of the H-plane Y-type single-ridge waveguide power divider on a left side is in butt joint with the left end face of the sixth rectangular cavity of the E-plane T-type single-ridge waveguide power divider, and the right end face of the first rectangular cavity of the H-plane Y-type single-ridge waveguide power divider on a right side is in butt joint with the right end face of the eighth rectangular cavity of the E-plane T-type single-ridge waveguide power divider. In this structure, the first H-plane step and the second H-plane step are used for impedance matching of the E-plane T-type waveguide power divider, so that a return loss is decreased. The third rectangular metal ridge and the forth rectangular metal ridge are used for expanding a bandwidth restrained by traditional waveguide structures, so that a relative bandwidth of the ultra-wideband CTS flat-plate array antenna is increased.

The feed network layer comprises a second metal plate and a feed network disposed on the second metal plate, the feed network comprises two feed units which are symmetrically arranged left and right, and the two feed units are connected through an E-plane T-type rectangular-single ridge waveguide power divider. Each feed unit comprises four single ridge waveguide-rectangular waveguide converters and three H-plane T-type single-ridge waveguide power dividers. The four single ridge waveguide-rectangular waveguide converters are sequentially arrayed at intervals from front to back, a first single ridge waveguide-rectangular waveguide converter is connected with a second single ridge waveguide-rectangular waveguide converter through a first H-plane T-type single-ridge waveguide power divider, a third single ridge waveguide-rectangular waveguide converter is connected with a fourth single ridge waveguide-rectangular waveguide converter through a second H-plane T-type single-ridge waveguide power divider, and the first H-plane T-type single-ridge waveguide power divider is connected with the second H-plane T-type single-ridge waveguide power divider through a third H-plane T-type single-ridge waveguide power divider. The third H-plane T-type single-ridge waveguide power dividers in the two feed units are connected with the E-plane T-type rectangular-single ridge waveguide power divider. In this structure, the H-plane T-type single-ridge waveguide power divider can increase the relative bandwidth of the ultra-wideband CTS flat-plate array antenna.

The E-plane T-type rectangular-single ridge waveguide power divider comprises a sixth rectangular metal block. A ninth rectangular cavity, a tenth rectangular cavity, an eleventh rectangular cavity, a twelfth rectangular cavity and a thirteenth rectangular cavity are sequentially formed in the sixth rectangular metal block from left to right, the ninth rectangular cavity, the tenth rectangular cavity, the eleventh rectangular cavity, the twelfth rectangular cavity and the thirteenth rectangular cavity are sequentially communicated, a left end face of the ninth rectangular cavity is flush with a left end face of the sixth rectangular metal block, a right end face of the ninth rectangular cavity is flush with a left end face of the tenth rectangular cavity, a right end face of the tenth rectangular cavity is flush with a left end face of the eleventh rectangular cavity, a right end face of the eleventh rectangular cavity is flush with a left end face of the twelfth rectangular cavity, a right end face of the twelfth rectangular cavity is flush with a left end face of the thirteenth rectangular cavity, and a right end face of the thirteenth rectangular cavity is flush with a right end face of the sixth rectangular metal block. An upper end face of the ninth rectangular cavity, an upper end face of the tenth rectangular cavity, an upper end face of the eleventh rectangular cavity, an upper end face of the twelfth rectangular cavity and an upper end face of the thirteenth rectangular cavity are arranged on an upper end face of the sixth rectangular metal block. A lower end face of the ninth rectangular cavity, a lower end face of the tenth rectangular cavity, a lower end face of the eleventh rectangular cavity, a lower end face of the twelfth rectangular cavity and a lower end face of the thirteenth rectangular cavity are located on the same plane and are higher than a lower end face of the sixth rectangular metal block. A length of the ninth rectangular cavity in the left-right direction is greater than that of the tenth rectangular cavity in the left-right direction and is smaller than that of the eleventh rectangular cavity in the left-right direction, the length of the ninth rectangular cavity in the left-right direction is equal to that of the thirteenth rectangular cavity in the left-right direction, and a length of the tenth rectangular cavity is equal to that of the twelfth rectangular cavity in the left-right direction. A front end face of the ninth rectangular cavity, a front end face of the tenth rectangular cavity, a front end face of the eleventh rectangular cavity, a front end face of twelfth rectangular cavity and a front end face of the thirteenth rectangular cavity are located on the same plane and are located behind a front end face of the sixth rectangular metal block. The length of the ninth rectangular cavity in the front-back direction is smaller than that of the tenth rectangular cavity in the front-back direction, the length of the tenth rectangular cavity in the front-back direction is smaller than that of the eleventh rectangular cavity in the front-back direction, the length of the ninth rectangular cavity in the front-back direction is equal to that of the thirteenth rectangular cavity in the front-back direction, and the length of the tenth rectangular cavity in the front-back direction is equal to that of the twelfth rectangular cavity in the front-back direction. The rear end face of the eleventh rectangular cavity is located in front of a rear end face of the sixth rectangular metal block, and a second rectangular metal base plate, a third rectangular metal base plate, a fourth rectangular metal base plate, a fifth rectangular metal base plate and a third H-plane step are arranged in the eleventh rectangular cavity. A front end face of the second rectangular metal base plate, a front end face of the third rectangular metal base plate, a front end face of the fourth rectangular metal base plate and a front end face of the fifth rectangular metal base plate are attached to a front end of the eleventh rectangular cavity. A rear end face of the second rectangular metal base plate, a rear end face of the third rectangular metal base plate, a rear end face of the fourth rectangular metal base plate and a rear end face of the fifth rectangular metal base plate are attached to the rear end face of the eleventh rectangular cavity. A length of the second rectangular metal base plate in the left-right direction is smaller than a quarter of a length of the eleventh rectangular cavity in the left-right direction, the length of the second rectangular metal base plate in the left-right direction is equal to that of the third rectangular metal base plate in the left-right direction, a length of the fourth rectangular metal base plate in the left-right direction is equal to that of the fifth rectangular metal base plate in the left-right direction, a length of the fifth rectangular metal base plate in the left-right direction is smaller than one fifth of a length of the third rectangular metal base plate in the left-right direction, a height of the second rectangular metal base plate, a height of the third rectangular metal base plate, a height of the fourth rectangular metal base plate and a height of the fifth rectangular metal base plate are equal and are smaller than one tenth of a height of the eleventh rectangular cavity, a lower end face of the second rectangular metal base plate and a lower end face of the third rectangular metal base plate are attached to the lower end face of the eleventh rectangular cavity, the fourth rectangular metal base plate is attached to an upper surface of the second rectangular metal base plate, a right end face of the fourth rectangular metal base plate is flush with a right end face of the second rectangular metal base plate, the length of the fourth rectangular metal base plate in the left-right direction is smaller than one fifth of the length of the second rectangular metal base plate in the left-right direction, the fifth rectangular metal base plate is attached to an upper surface of the third rectangular metal base plate, a left end face of the fifth rectangular metal base plate is flush with a left end face of the third rectangular metal base plate, the second rectangular metal base plate is located on a left side of a vertical plane where a center line of the eleventh rectangular cavity in the left-right direction is located, a distance from the right end face of the second rectangular metal base plate to the vertical plane where the center line of the eleventh rectangular cavity in the left-right direction is located is half of a width of a standard waveguide port WR-28, the third rectangular base plate is located on a right side of the vertical plate where the center line of the eleventh rectangular cavity in the left-right direction is located, a distance from the left end face of the third rectangular metal base plate to the vertical plane where the center line of the eleventh rectangular cavity in the left-right direction is located is half of a width of the standard waveguide port WR-28, a front end face of the third H-plane step is attached to the front end face of the eleventh rectangular cavity, a rear end face of the third H-plane step is attached to the rear end face of the eleventh rectangular cavity, an upper end face of the third H-plane step is flush with the upper end face of the sixth rectangular metal block, a vertical plane where a center line of the third H-plane step in the left-right direction is located coincides with the vertical plane where the center line of the eleventh rectangular cavity in the left-right direction is located, a width of the third H-plane step in the left-right direction is smaller than that of the standard waveguide port WR-28, and a height of the third H-plane step is smaller than half that of the eleventh rectangular cavity. A first ridge step is arranged in the ninth rectangular cavity, a second ridge step is arranged in the tenth rectangular cavity, a third ridge step and a fourth ridge step are arranged in the eleventh rectangular cavity, a fifth ridge step is arranged in the twelfth rectangular cavity, a sixth ridge step is arranged in the thirteenth rectangular cavity, and the first ridge step, the second ridge step, the third ridge step, the fourth ridge step, the fifth ridge step and the sixth ridge step are all rectangular. A left end face of the first ridge step is flush with the left end face of the ninth rectangular cavity, a right end face of the first ridge step is flush with the right end face of the ninth rectangular cavity, a height of the first ridge step is smaller than that of the ninth rectangular cavity, a length of the first ridge step in the front-back direction is smaller than that of the ninth rectangular cavity in the front-back direction, a distance between a front end face of the first ridge step and the front end face of the ninth rectangular cavity is equal to a distance between a rear end face of the first ridge step and a rear end face of the ninth rectangular cavity, a left end face of the second ridge step is attached to the right end face of the first ridge step, a right end face of the second ridge step is flush with the right end face of the tenth rectangular cavity, a front end face of the second ridge step is flush with the front end face of the first ridge step, a rear end face of the second ridge step is flush with the rear end face of the first ridge step, a height of the second ridge step is smaller than that of the first ridge step, a left end face of the third ridge step is attached to the right end face of the second ridge step, a right end face of the third ridge step is located in the eleventh rectangular cavity, the right end face of the third ridge step is spaced from a left end face of the second rectangular metal base plate by a certain distance which is smaller than the length of the second rectangular metal base plate in the left-right direction, a front end face of the third ridge step is flush with the front end face of the second ridge step, a rear end face of the third ridge step is flush with the rear end face of the second ridge step, a height of the third ridge step is smaller than that of the second ridge step, a right end face of the fourth ridge step is flush with the right end face of the thirteenth rectangular cavity, a left end face of the fourth ridge step is flush with the left end face of the thirteenth rectangular cavity, a height of the fourth ridge step is equal to that of the first ridge step, a length of the fourth ridge step in the front-back direction is equal to that of the first ridge step in the front-back direction, a distance between a front end face of the fourth ridge step and the front end face of the thirteenth rectangular cavity is equal to a distance between a rear end face of the fourth ridge step and a rear end face of the thirteenth rectangular cavity, a right end face of the fifth ridge step is attached and connected to the left end face of the fourth ridge step, a left end face of the fifth ridge step is flush with a left end face of the twelfth rectangular cavity, a front end face of the fifth ridge step is flush with the front end face of the fourth ridge step, a rear end face of the fifth ridge step is flush with the rear end face of the fourth ridge step, a height of the fifth ridge step is equal to that of the second ridge step, a right end face of the sixth ridge step is attached to the left end face of the fifth ridge step, a left end face of the sixth ridge step is located in the eleventh rectangular cavity, the left end face of the sixth ridge step is spaced from a right end face of the third rectangular metal base plate by a certain distance which is smaller than the length of the third rectangular metal base plate in the left-right direction, a front end face of the sixth ridge step is flush with the front end face of the fifth ridge step, a rear end face of the sixth ridge step is flush with the rear end face of the fifth ridge step, a height of the sixth ridge step is equal to that of the third ridge step, a rectangular waveguide input port communicated with the eleventh rectangular cavity is formed in the sixth rectangular metal block, a lower end of the rectangular waveguide input port is located on the lower end face of the sixth rectangular metal block, an upper end of the rectangular waveguide input port is communicated with the lower end face of the eleventh rectangular cavity, a front end face of the rectangular waveguide input port is flush with the front end face of the eleventh rectangular cavity, a rear end face of the rectangular waveguide input port is flush with the rear end face of the eleventh rectangular cavity, a left end face of the rectangular waveguide input port is flush with the right end face of the second rectangular metal base plate, and a right end face of the rectangular waveguide input port is flush with the left end face of the third rectangular metal base plate. A first output port of the E-plane T-type rectangular-single ridge waveguide power divider is formed in the left end face of the ninth rectangular cavity, a second output port of the E-plane T-type rectangular-single ridge waveguide power divider is formed in the right end face of the thirteenth rectangular cavity, and output ports of the E-plane T-type rectangular-single ridge waveguide power divider are in butt joint with the H-plane T-type single-ridge waveguide power divider. In this structure, the ninth rectangular cavity, the tenth rectangular cavity, the eleventh rectangular cavity, the twelfth rectangular cavity and the thirteenth rectangular cavity can fulfill multi-step transition, so that the bandwidth is increased. The second rectangular metal base plate, the third rectangular metal base plate, the fourth rectangular metal base plate, the fifth rectangular metal base plate and the third H-plane step are used for impedance matching, so that the return loss caused by structural discontinuity is decreased. The first ridge step, the second ridge step, the third ridge step, the fourth ridge step, the fifth ridge step and the sixth ridge step can increase the relative bandwidth of the structure.

The H-plane T-type single-ridge waveguide power divider comprises a seventh rectangular block. A fourteenth rectangular cavity and a fifteenth rectangular cavity are formed in the seventh rectangular metal block, the fourteenth rectangular cavity is communicated with the fifteenth rectangular cavity, a front end face of the fourteenth rectangular cavity is flush with a front end face of the seventh rectangular metal block, a rear end face of the seventh rectangular metal block is flush with the front end face of the seventh rectangular metal block, a left end face of the fifteenth rectangular cavity is flush with a left end face of the seventh rectangular metal block, a right end face of the fifteenth rectangular cavity is flush with a left end face of the fourteenth rectangular cavity, a center line of the fifteenth rectangular cavity in the front-back direction and a center line of the seventh rectangular metal block in the front-back direction are located on the same vertical plane, an upper end face of the fourteenth rectangular cavity and an upper end face of the fifteenth rectangular cavity are flush with an upper end face of the seventh rectangular metal block, and a height of the fourteenth rectangular cavity is equal to that of the fifteenth rectangular cavity. A fifth rectangular metal ridge, a sixth rectangular metal base plate and a sixth rectangular metal ridge are sequentially arranged in the fourteenth rectangular cavity from front to back. A front end face of the fifth rectangular metal ridge is flush with the front end face of the fourteenth rectangular cavity, a rear end face of the fifth rectangular metal ridge is flush with a front end face of the fifteenth rectangular cavity, the rear end face of the sixth rectangular metal ridge is flush with a rear end face of the fourteenth rectangular cavity, a front end face of the sixth rectangular metal ridge is flush with a rear end face of the fifteenth rectangular cavity, a height of the fifth rectangular metal ridge is equal to that of the sixth rectangular metal ridge and is equal to half that of the fourteenth rectangular cavity, a length of the fifth rectangular metal ridge in the left-right direction is equal to that of the sixth rectangular metal ridge in the left-right direction, the length of the fifth rectangular metal ridge in the left-right direction is smaller than a quarter of a length of the fourteenth rectangular cavity in the left-right direction, a left end face of the fifth rectangular metal ridge is flush with a left end face of the sixth rectangular metal ridge, a right end face of the fifth rectangular metal ridge is flush with a right end face of the sixth rectangular metal ridge, a front end face of the sixth rectangular metal base plate makes contact with the rear end face of the fifth rectangular metal ridge, a rear end face of the sixth rectangular metal base plate makes contact with the front end face of the sixth rectangular metal ridge, a left end face of the sixth rectangular metal base plate is flush with the left end face of the fourteenth rectangular cavity, a right end face of the sixth rectangular metal base plate is flush with a right end face of the fourteenth rectangular cavity, a height of the sixth rectangular metal base plate is smaller than a quarter of the height of the fourteenth rectangular cavity, a seventh rectangular metal ridge is arranged in the fifteenth rectangular cavity, a left end face of the seventh rectangular metal ridge is flush with the left end face of the fifteenth rectangular cavity, a right end face of the seventh rectangular metal ridge makes contact with the left end face of the sixth rectangular metal base plate, a length of the seventh rectangular metal ridge in the front-back direction is equal to that of the fifth rectangular metal ridge in the left-right direction, a distance between a front end face of the seventh rectangular meal ridge and a front end face of the fifteenth rectangular cavity is equal to a distance between a rear end face of the seventh rectangular metal ridge and the rear end face of the fifteenth rectangular cavity, a length of the fifteenth rectangular cavity in the left-right direction is equal to that of the ninth rectangular cavity in the front-back direction, the left end face of the fifteenth rectangular cavity in the H-plane T-type single-ridge waveguide power divider is in butt joint with the output ports of the E-plane T-type rectangular-single ridge waveguide power divider, and the left end face and the right end face of the fourteenth rectangular cavity in the H-plane T-type single-ridge waveguide power divider are in butt joint with corresponding single ridge waveguide-rectangular waveguide converters. In this structure, the sixth rectangular metal base plate is arranged at a center of the fourteenth rectangular cavity in the H-plane T-type single-ridge waveguide power divider, and the fifth rectangular metal ridge, the sixth rectangular metal ridge, the seventh rectangular metal ridge and the sixth rectangular metal base plate are used for impedance matching, so that the return loss caused by structural discontinuity is decreased, and this structure has a good wideband transmission property.

The single ridge waveguide-rectangular waveguide converter comprises an eighth rectangular metal block, a sixteenth rectangular cavity is formed in the eighth rectangular metal block, a first E-plane step is arranged on the left side of the sixteenth rectangular cavity and is rectangular, a height of the first E-plane step is smaller than that of the sixteenth rectangular cavity, the first E-plane step is connected with a front end face, a rear end face and a left end face of the sixteenth rectangular cavity, a fourth H-plane step is arranged on a right side of the sixteenth rectangular cavity and is connected with a right end face and the rear end face of the sixteenth rectangular cavity, a height of the fourth H-plane step is equal to that of the sixteenth rectangular cavity, a rectangular waveguide output port communicated with the sixteenth rectangular cavity is formed in an upper surface of the eighth rectangular metal block, a single-ridge waveguide input port is formed in a front side face of the eighth rectangular metal block and is communicated with the sixteenth rectangular cavity, a height of the single-ridge waveguide input port is equal to that of the sixteenth rectangular cavity, a bottom surface of the single-ridge waveguide input port and a bottom surface of the sixteenth rectangular cavity are located on the same plane, a first ridge step extending onto the bottom surface of the sixteenth rectangular cavity is arranged on the bottom surface of the single-ridge waveguide input port, and comprises a first rectangular ridge and a second rectangular ridge which are sequentially connected, a height of the first rectangular ridge is greater than that of the second rectangular ridge, the height of the first rectangular ridge is smaller than that of the sixteenth rectangular cavity, a size of the single-ridge waveguide input port is matched with that of the left end face of the fourteenth rectangular cavity in the H-plane T-type single-ridge waveguide power divider, the single-ridge waveguide input port is in butt joint with the left end face or the right end face of the fourteenth rectangular cavity in the H-plane T-type single-ridge waveguide power divider. In this structure, the first ridge step, the first E-plane step and the fourth H-plane step are used for impedance matching, so that the return loss caused by structural discontinuity is decreased, and this structure has a good wideband transmission property.

Compared with the prior art, the invention has the following advantages: the feed network layer is formed by a plurality of H-plane T-type single-ridge waveguide power dividing networks and a plurality of E-plane T-type rectangular-single ridge waveguide power dividers and is used for converting a single path of TE10 mode signals fed via the standard waveguide port into a plurality of paths of same-power in-phase TE10 mode signals, and all the H-plane T-type single-ridge waveguide power dividing networks fulfills input and output in the same direction, so that the structure is compact, the cut-off frequency can be decreased, the dominant-mode bandwidth is increased, the wide-edge size and the narrow-edge height can be reduced by the H-plane T-type single-ridge waveguide power dividing networks under a given frequency, and a low profile can be realized. The multiple paths of TE10 mode signals are fed into the mode switching layer comprising the first metal plate and the mode switching cavity array disposed on the upper surface of the first metal plate by the E-plane T-type single-ridge waveguide power dividers, the mode switching cavity converts the multiple paths of same-power in-phase TE10 mode signals into four paths of quasi-TEM mode waves by means of the compact-structure wideband H-plane Y-type single-ridge waveguide power dividers, the mode switching layer adjusts the discontinuity of the H-plane Y-type single-ridge waveguide power divider through the first metal base plate and the second metal column and fulfills multi-step transition through the first rectangular cavity, the isosceles-trapezoid cavity, the second rectangular cavity, the third rectangular cavity, the fourth rectangular cavity, the fifth rectangular cavity, the second rectangular metal block, the third rectangular metal block and the fourth rectangular metal block, so that the bandwidth of the antenna is increased, and the antenna has a wide relative bandwidth; and the quasi-TEM waves output by the mode switching cavity are radiated out by the radiating layer to form plane waves, and the CTS flat-plate array antenna can obtain a high gain and a low side lobe under a wideband transmission condition.

BRIEF DESCRIPTION OF THE DRAWINGS

FIG. 9(*b*) is an exploded view of the single ridge waveguide-rectangular waveguide converter of the ultra-wideband CTS flat-plate array antenna of the invention;

DESCRIPTION OF THE EMBODIMENTS

Figure 1:
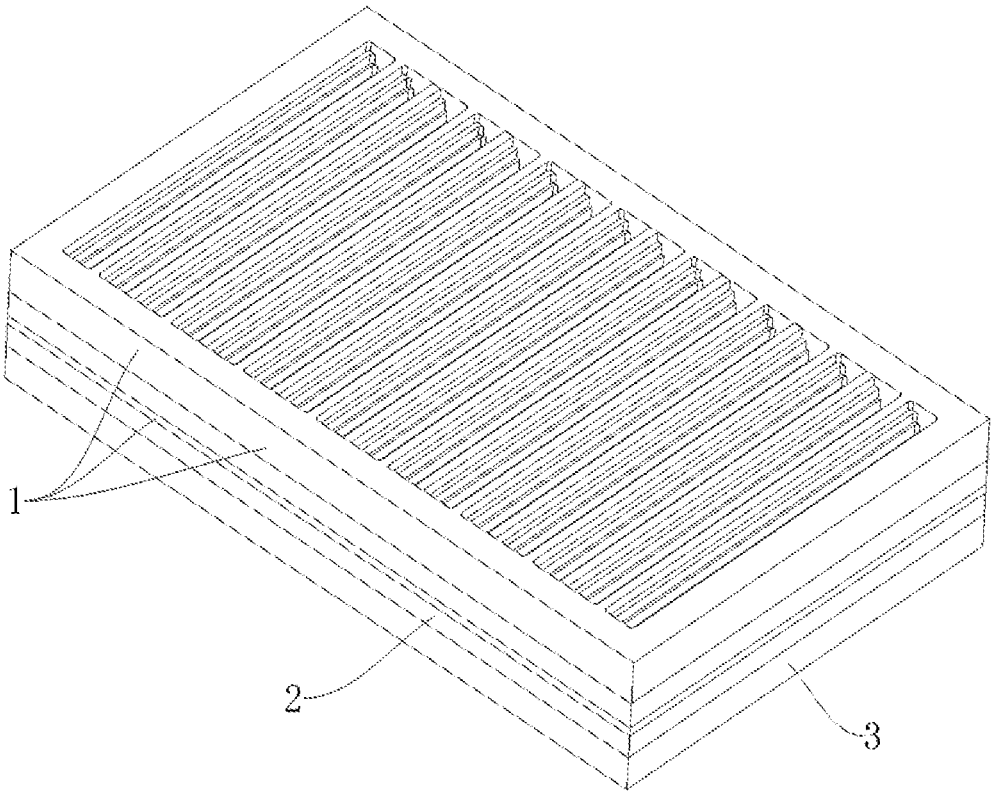
FIG. 1 is a structural view of an ultra-wideband CTS flat-plate array antenna of the invention.
Figure 2:
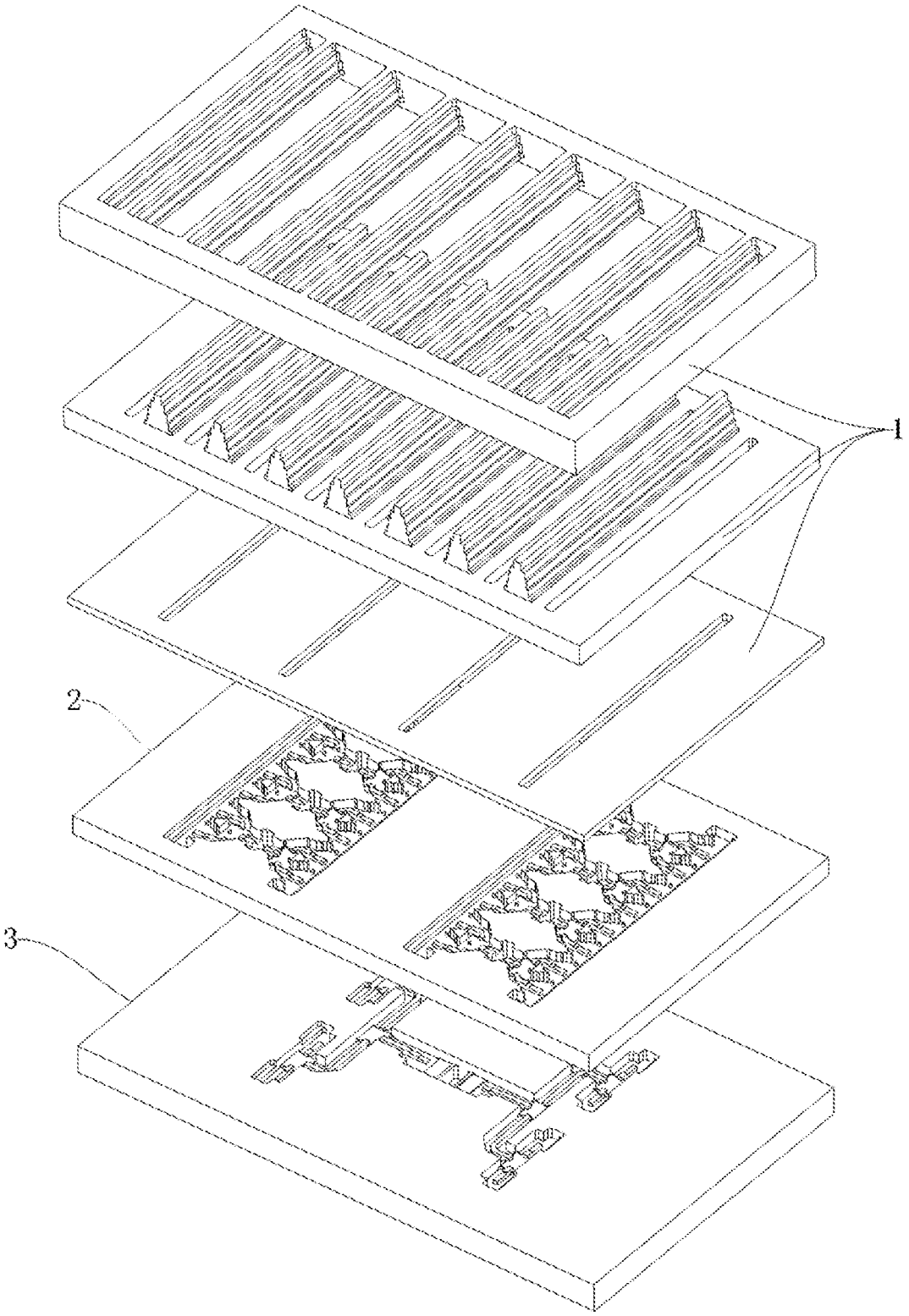
FIG. 2 is an exploded view of the ultra-wideband CTS flat-plate array antenna of the invention.
Figure 3:
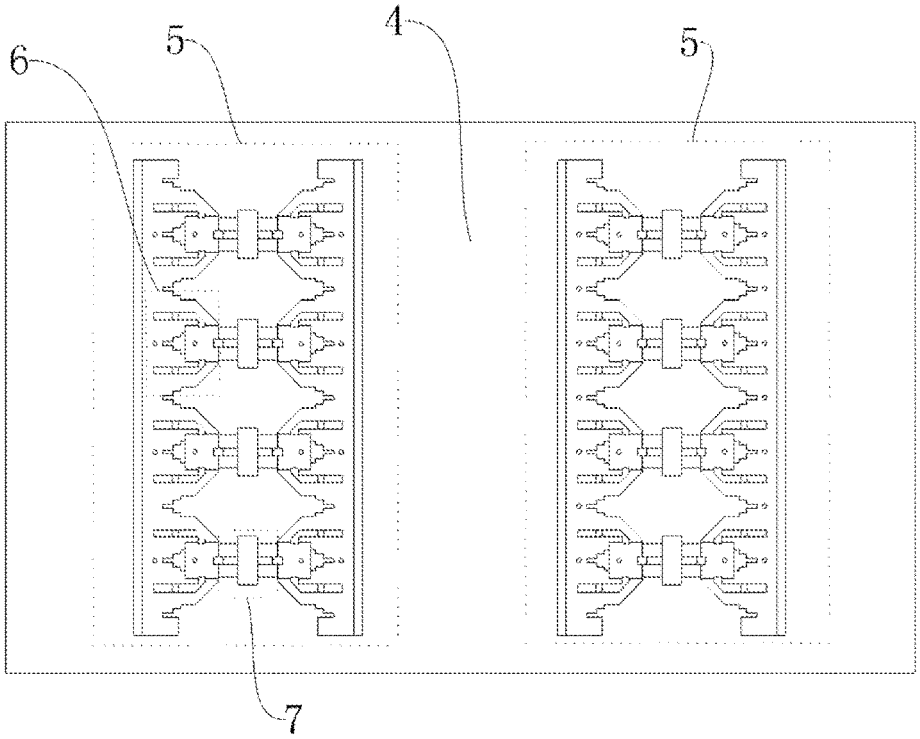
FIG. 3 is a top view of a mode switching layer of the ultra-wideband CTS flat-plate array antenna of the invention.
Figure 4:
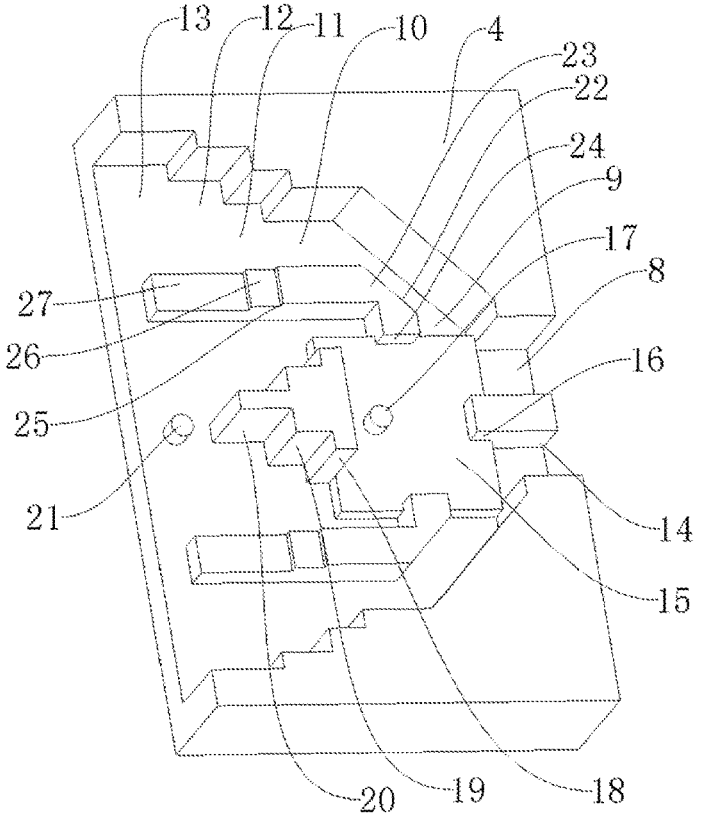
FIG. 4 is a perspective view of an H-plane Y-type single-ridge waveguide power divider of the ultra-wideband CTS flat-plate array antenna of the invention.
Figure 5:
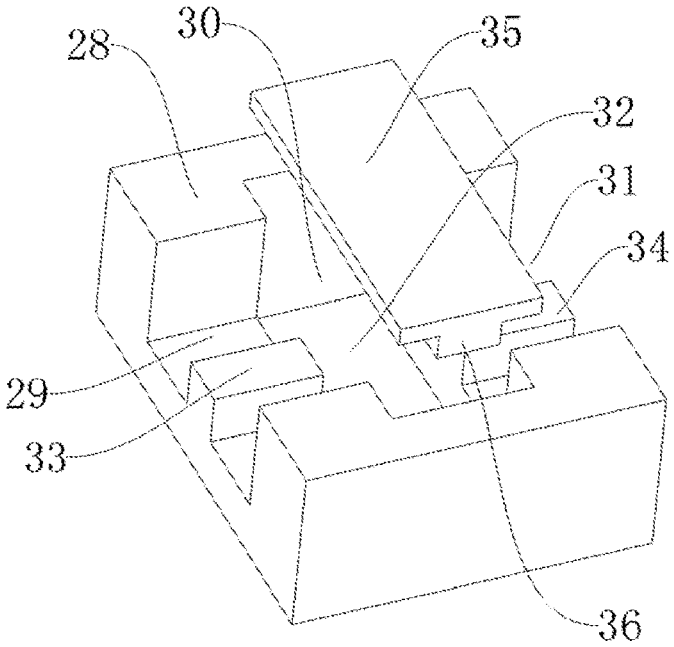
FIG. 5 is a perspective view of an E-plane T-type single-ridge waveguide power divider of the ultra-wideband CTS flat-plate array antenna of the invention.
Figure 6:
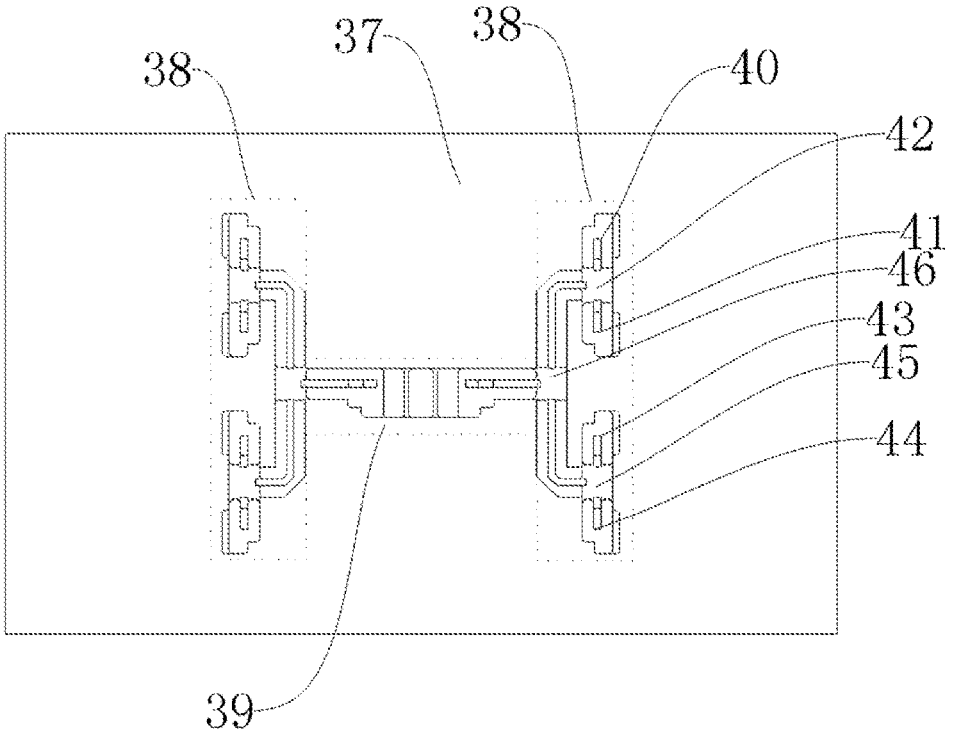
FIG. 6 is a structural view of a feed network layer of the ultra-wideband CTS flat-plate array antenna of the invention.
Figure 7:
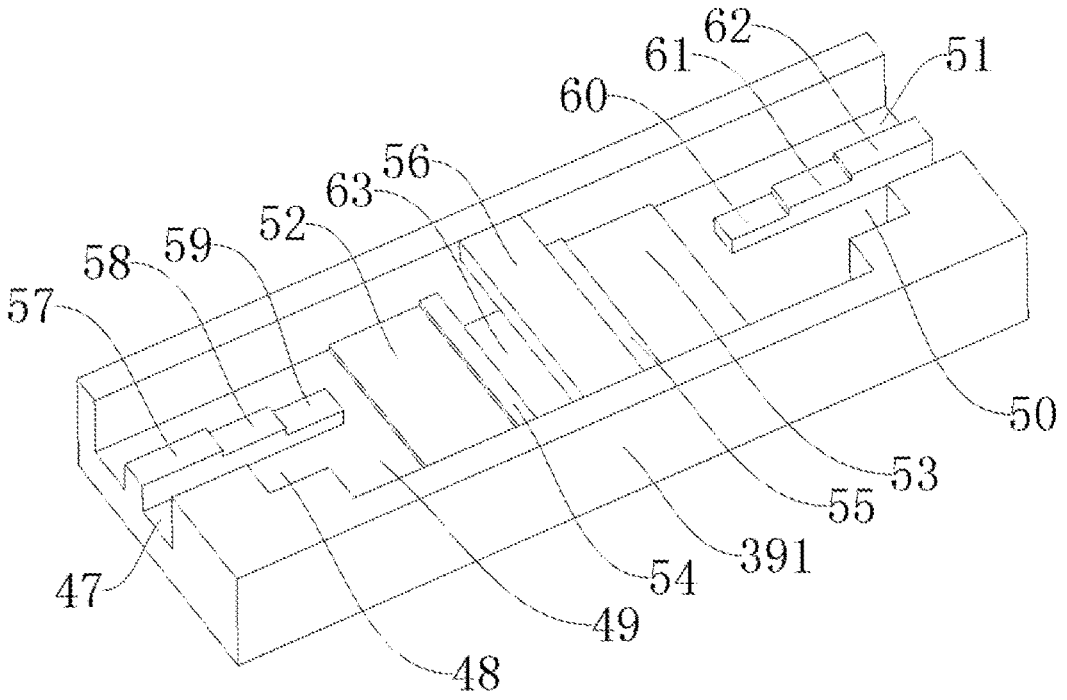
FIG. 7 is a perspective view of an E-plane T-type rectangular-single ridge waveguide power divider of the ultra-wideband CTS flat-plate array antenna of the invention.
Figure 8:
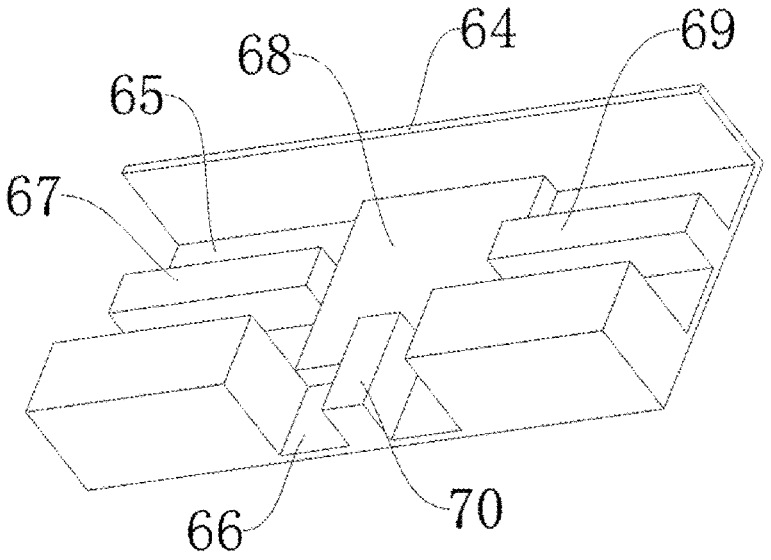
FIG. 8 is a perspective view of an H-plane T-type single-ridge waveguide power divider of the ultra-wideband CTS flat-plate array antenna of the invention.
Figure 9A:
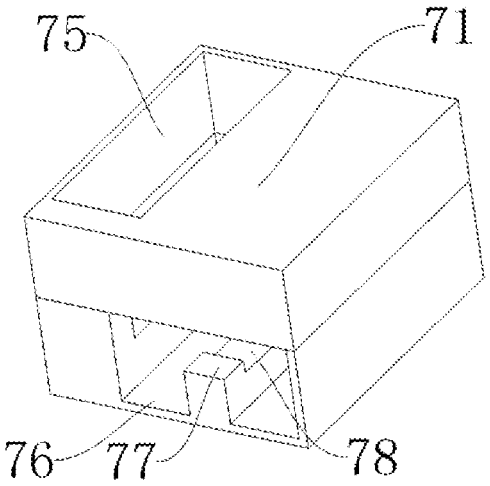
FIG. 9(*a*) is a perspective view of a single ridge waveguide-rectangular waveguide converter of the ultra-wideband CTS flat-plate array antenna of the invention.
Figure 9B:
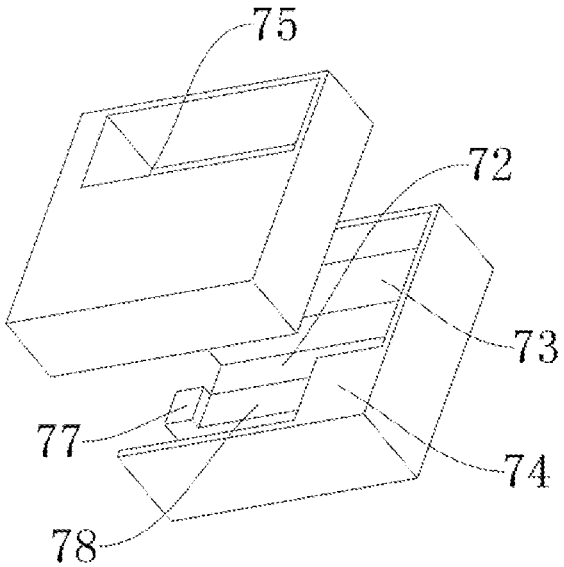

The invention is further expounded below with reference to the accompanying drawings and embodiments.

Embodiment 1

As shown in the figures, an ultra-wideband CTS flat-plate array antenna comprises a radiating layer 1, a mode switching layer 2 and a feed network layer 3 which are sequentially arrayed from top to bottom. The mode switching layer 2 comprises a first metal plate 4 and a mode switching cavity formed in the first metal plate 4. The mode switching cavity comprises two mode switching units 5 which are identical in structure and are arranged left and right in a spaced manner. Each mode switching unit 5 comprises eight H-plane Y-type single-ridge waveguide power dividers 6 which are arrayed in 4 rows and 2 columns, wherein the H-plane Y-type single-ridge waveguide power divider 6 in the $m^{th}$ row and $1^{st}$ column is bilaterally symmetrical with the H-plane Y-type single-ridge waveguide power divider 6 in the $m^{th}$ row and $2^{nd}$ column, and m=1, 2, 3 and 4. The two H-plane Y-type single-ridge waveguide power dividers 6 in each row are connected through an E-plane T-type single-ridge waveguide power divider 7, and the center distance between every two adjacent H-plane Y-type single-ridge waveguide power dividers 6 in each column is not over one wavelength.

The H-plane Y-type single-ridge waveguide power divider 6 in the $m^{th}$ row and $1^{st}$ column comprises a first rectangular cavity 8, an isosceles-trapezoid cavity 9, a second rectangular cavity 10, a third rectangular cavity 11, a fourth rectangular cavity 12 and a fifth rectangular cavity 13 which are sequentially formed in an upper end face of the first metal plate 4 from right to left, the first rectangular cavity 8, the isosceles-trapezoid cavity 9, the second rectangular cavity 10, the third rectangular cavity 11, the fourth rectangular cavity 12 and the fifth rectangular cavity 13 are sequentially communicated front and back, are identical in height and are lower than the first metal plate 4, and center lines of the first rectangular cavity 8, the isosceles-trapezoid cavity 9, the second rectangular cavity 10, the third rectangular cavity 11, the fourth rectangular cavity 12 and the fifth rectangular cavity 13 in the front-back direction are located on the same straight line. A length direction of the first rectangular cavity 8, the second rectangular cavity 10, the third rectangular cavity 11, the fourth rectangular cavity 12 and the fifth rectangular cavity 13 is defined as a front-back direction of the first metal plate 4, and a width direction of the first rectangular cavity 8, the second rectangular cavity 10, the third rectangular cavity 11, the fourth rectangular cavity 12 and the fifth rectangular cavity 13 is defined as a left-right direction of the first metal plate 4. A right end face of the isosceles-trapezoid cavity 9 is parallel to a left end face of the isosceles-trapezoid cavity 9 and is smaller than the left end face of the isosceles-trapezoid cavity 9 in size, and a front end face of the isosceles-trapezoid cavity 9 is equal to the rear end face of the isosceles-trapezoid cavity 9. A right end face of the first rectangular cavity 8 is flush with the left end face of the isosceles-trapezoid cavity 9, a length of the first rectangular cavity 8 is smaller than that of the right end face of the isosceles-trapezoid cavity 9 in the front-back direction of the first metal plate 4, the left end face of the isosceles-trapezoid cavity 9 overlaps a right end face of the second rectangular cavity 10 and is as large as the right end face of the second rectangular cavity 10, a left end face of the second rectangular cavity 10 is flush with a right end face of the third rectangular cavity 11, a length of the third rectangular cavity 11 is greater than that of the second rectangular cavity 10, a left end face of the third rectangular cavity 11 is flush with a right end face of the fourth rectangular cavity 12, a length of the fourth rectangular cavity 12 is greater than that of the third rectangular cavity 11, a left end face of the fourth rectangular cavity 12 is flush with a right end face of the fifth rectangular cavity 13, and a length of the fifth rectangular cavity 13 is greater than that of the fourth rectangular cavity 12. A first rectangular metal ridge 14 is arranged in the first rectangular cavity 8, a right end face of the first rectangular metal ridge 14 is flush with the right end face of the first rectangular cavity 8, a left end face of the first rectangular metal ridge 14 is flush with a left end face of the first rectangular cavity 8, a height of the first rectangular metal ridge 14 is half that of the first rectangular cavity 8, a length of the first rectangular metal ridge 14 in the front-back direction of the first metal plate 4 is smaller than a quarter of the length of the first rectangular cavity 8, and a distance between a front end face of the first rectangular metal ridge 14 and a front end face of the first rectangular cavity 8 is equal to a distance between a rear end face of the first rectangular metal ridge 14 and a rear end face of the first rectangular cavity 8. A first rectangular metal base plate 15 and a second rectangular metal ridge 16 are arranged in the isosceles-trapezoid cavity 9, a height of the first rectangular metal base plate 15 is smaller than a quarter of a height of the isosceles-trapezoid cavity 9, a right end face of the first rectangular metal base plate 15 is flush with the right end face of the isosceles-trapezoid cavity 9, a left end face of the first rectangular metal base plate 15 is located in the second rectangular cavity 10, a length of the first rectangular metal base plate 15 in the front-back direction of the first metal plate 4 is greater than that of the first rectangular cavity 8 and is smaller than that of the right end face of the isosceles-trapezoid cavity 9 in the front-back direction of the first metal base plate 4, a distance between a front end face of the first rectangular metal base plate 15 and a front end face of the second rectangular cavity 10 is equal to a distance between a rear end face of the first rectangular metal base plate 15 and a rear end face of the second rectangular cavity 10, a lower end face of the second rectangular metal ridge 16 is attached to an upper end face of the first rectangular metal base plate 15, a right end face of the second rectangular metal ridge 16 is flush with the left end face of the first rectangular metal ridge 14, an upper end face of the second rectangular metal ridge 16 and an upper end face of the first rectangular metal ridge 14 are located on the same plane, a length of the second rectangular metal ridge 16 in the left-right direction of the first metal plate 4 is not greater than a quarter of a length of the isosceles-trapezoid cavity 9 in the left-right direction of the first metal plate 4. A first metal cylinder 17 is arranged on the first rectangular metal base plate 15, a lower end face of the first metal cylinder 17 is attached to the upper end face of the first rectangular metal base plate 15, the center of the first metal cylinder 17 is located on the center line of the upper end face of the first rectangular metal base plate 15 in the left-right direction of the first metal plate 4 and is also located on the left end face of the isosceles-trapezoid cavity 9, a diameter of the first metal cylinder 17 is smaller than a width of the first rectangular metal ridge 14 and is greater than 0.5 mm, and a height of the first metal cylinder 17 is smaller than a quarter of the height of the isosceles-trapezoid cavity 9. A first rectangular metal baffle 18 is arranged in the second rectangular cavity 10, a right end face of the first rectangular metal baffle 18 is flush with the left end face of the first rectangular metal base plate 15, a left end face of the first rectangular metal baffle 18 is flush with the left end face of the second rectangular cavity 10, a length of the first rectangular metal baffle 18 in the front-back direction of the first metal plate 4 is smaller than that of the first rectangular metal base plate 15 in the front-back direction of the first metal plate 4 and is greater than that of the first rectangular metal ridge 14 in the front-back direction of the first metal plate 4, the length of the first rectangular metal baffle 18 in the left-right direction of the first metal plate 4 is smaller than half of a width of the second rectangular cavity 10, a height of the first rectangular metal baffle 18 is equal to that of the second rectangular cavity 10, and a distance between a front end face of the first rectangular metal baffle 18 and the front end face of the second rectangular cavity 10 is equal to the distance between a rear end face of the first rectangular metal baffle 18 and the rear end face of the second rectangular cavity 10. A second rectangular metal baffle 19 is arranged in the third rectangular cavity 11, a right end face of the second rectangular metal baffle 19 is flush with the right end face of the first rectangular metal baffle 18, a left end face of the second rectangular metal baffle 19 is flush with the left end face of the third rectangular cavity 11, a length of the second rectangular metal baffle 19 in the front-back direction of the first metal plate 4 is smaller than that of the first rectangular metal baffle 18 in the front-back direction of the first metal plate 4 and is greater than half that of the first rectangular metal baffle 18 in the front-back direction of the first metal plate 4, a height of the second rectangular metal baffle 19 is equal to that of the third rectangular cavity 11, and a distance between a front end face of the second rectangular metal baffle 19 and the front end face of the third rectangular cavity 11 is equal to a distance between a rear end face of the second rectangular metal baffle 19 and a rear end face of the third rectangular cavity 11. A third rectangular metal baffle 20 is arranged in the fourth rectangular cavity 12, a right end face of the third rectangular metal baffle 20 is flush with the rear end face of the second rectangular metal baffle 19, a left end face of the third rectangular metal baffle 20 is flush with the left end face of the fourth rectangular cavity 12, a height of the third rectangular metal baffle 20 is equal to that of the fourth rectangular cavity 12, a length of the third rectangular metal baffle 20 in the front-back direction of the first metal plate 4 is smaller than the diameter of the first metal cylinder 17 and is greater than 0.5 mm, a distance between a front end face of the third rectangular metal baffle 20 and the front end face of the fourth rectangular cavity 12 is equal to a distance between a rear end face of the third rectangular metal baffle 20 and a rear end face of the fourth rectangular cavity 12, a second metal cylinder 21 is arranged in the fifth rectangular cavity 13, a diameter of the second metal cylinder 21 is equal to that of the first metal cylinder 17, a height of the second metal cylinder 21 is smaller than half that of the fifth rectangular cavity 13, and a center of the second metal cylinder and a center of the fifth rectangular cavity 13 are located on the same straight line. The H-plane Y-type single-ridge waveguide power divider 6 further comprises a first ridge assembly and a second ridge assembly which are symmetrically arranged in the front-back direction of the first metal plate 4, and the first ridge assembly comprises a first right-trapezoid metal block 22, a second right-trapezoid metal block 23, a first rectangular metal block 24, a second rectangular metal block 25, a third rectangular metal block 26 and a fourth rectangular metal block 27. The first rectangular metal block 24 is located on the first rectangular metal base plate 15, a lower end face of the first rectangular metal block 24 is attached to the upper end face of the first rectangular metal base plate 15, a front end face of the first rectangular metal block 24 is flush with the front end face of the first rectangular metal base plate 15, a length of the first rectangular metal block 24 in the front-back direction of the first metal plate 4 is smaller than one tenth of the length of the first rectangular metal base plate 15 in the front-back direction of the first metal plate 4, the length of the first rectangular metal block 24 in the left-right direction of the first metal plate 4 is equal to that of the first rectangular metal ridge 14 in the front-back direction of the first metal plate 4, a sum of a height of the first rectangular metal block 24 and the height of the first rectangular metal base plate 15 is equal to the height of the first rectangular metal ridge 14, and a distance between a right end face of the first rectangular metal block 24 and the right end face of the first rectangular metal base plate 15 is equal to a distance between a left end face of the first rectangular metal block 24 and the left end face of the first rectangular metal base plate 15. The first right-trapezoid metal block 22 and the second right-trapezoid metal block 23 are located in the isosceles-trapezoid cavity 9, the first right-trapezoid metal block 22 is located in front of the first rectangular metal block 24, a left end face of the first right-trapezoid metal block 22 is parallel to a right end face of the first right-trapezoid metal block 22, the right end face of the first right-trapezoid metal block 22 is smaller than the left end face of the first right-trapezoid metal block 22, a rear end face of the first right-trapezoid metal block 22, the front end face of the first rectangular metal base plate 15 and the front end face of the first rectangular metal block 24 are connected and are located on the same plane, a front end face of the first right-trapezoid metal block 22 is parallel to the front end face of the isosceles-trapezoid cavity 9, a height of the first right-trapezoid metal block 24 is equal to that of the first rectangular metal ridge 14, a lower end face of the first right-trapezoid metal block 22 is attached to a lower end face of the isosceles-trapezoid cavity 9, the second right-trapezoid metal block 23 is located on a left side of the first right-trapezoid metal block 22, a right end face of the second right-trapezoid metal block 23 and the left end face of the first right-trapezoid metal block 22 are connected and are located on the same plane, a left end face of the second right-trapezoid metal block 23 is parallel to the right end face of the second right-trapezoid metal block 23, the right end face of the second right-trapezoid metal block 23 is smaller than the left end face of the second right-trapezoid metal block 23, a front end face of the second right-trapezoid metal block 23 and the front end face of the first right-trapezoid metal block 22 are connected and are located on the same plane, a length of the left end face of the second right-trapezoid metal block 23 in the front-back direction of the first metal plate 4 is equal to that of the first right-trapezoid metal block 22 in the left-right direction of the first metal plate 4, a height of the second right-trapezoid metal block 23 is equal to that of the first rectangular metal ridge 14, and a lower end face of the second right-trapezoid metal block 23 is attached to the lower end face of the isosceles-trapezoid cavity 9. A right end face of the second rectangular metal block 25 overlaps the left end face of the second right-trapezoid metal block 23, a left end face of the second rectangular metal block 25 is located in the third rectangular cavity 11, a distance between a front end face of the second rectangular metal block 25 and the front end face of the second rectangular cavity 10 is equal to a distance between a rear end face of the second rectangular metal block 25 and a front end face of the second rectangular metal baffle 19, a height of the second rectangular metal block 25 is equal to that of the first rectangular metal ridge 14, a length of a part, located in the third rectangular cavity 11, of the second rectangular metal block 25 in the left-right direction of the first metal plate 4 is not greater than one third of a width of the third rectangular cavity 11, and a lower end face of the second rectangular metal block 25 is attached to a lower end face of the second rectangular cavity 10 and a lower end face of the third rectangular cavity 11. A right end face of the third rectangular metal block 26 overlaps a left end face of the second rectangular block, a left end face of the third rectangular metal block 26 is located in the fourth rectangular cavity 12, a length of a part, located in the fourth rectangular cavity 12, of the third rectangular metal block 26 in the left-right direction of the first metal plate 4 is not greater than one fifth of a width of the fourth rectangular cavity 12, and a height of the third rectangular metal block 26 is smaller than that of the second rectangular metal block 25 and is greater than half that of the second rectangular metal block 25. A right end face of the fourth rectangular metal block 27 overlaps the left end face of the third rectangular metal block 26, a rear end face of the fourth rectangular metal block 27 is located in the fifth rectangular cavity 13, and a length of a part, located in the fifth rectangular cavity 13, of the fourth rectangular metal block 27 in the left-right direction of the first metal plate 4 is greater than half of a width of the fifth rectangular cavity, and a height of the fourth rectangular metal block 27 is smaller than that of the third rectangular metal block 26 and is greater than half that of the third rectangular metal block 26.

In this embodiment, the E-plane T-type single-ridge waveguide power divider 7 comprises a fifth rectangular metal block 28. A sixth rectangular cavity 29, a seventh rectangular cavity 30 and an eighth rectangular cavity 31 are sequentially formed in the upper surface of the fifth rectangular metal block 28 from left to right, and the sixth rectangular cavity 29, the seventh rectangular cavity 30 and the eighth rectangular cavity 31 are sequentially communicated, are identical in height and are as high as the first rectangular cavity 8. A center line of the sixth rectangular cavity 29 in the left-right direction, a center line of the seventh rectangular cavity 30 in the left-right direction and a center line of the eighth rectangular cavity 31 in the left-right direction are located on the same straight line, a left end face of the sixth rectangular cavity 29 is located on a left end face of the fifth rectangular metal block 28, a right end face of the sixth rectangular cavity 29 is flush with a left end face of the seventh rectangular cavity 30, a right end face of the seventh rectangular cavity 30 is flush with a left end face of the eighth rectangular cavity 31, a right end face of the eighth rectangular cavity 31 is located on a right end face of the fifth rectangular metal block 28, a rectangular waveguide port 32 is formed below the seventh rectangular cavity 30, an upper end face of the rectangular waveguide port 32 overlaps a lower end face of seventh rectangular cavity 30, a lower end face of the rectangular waveguide port 32 is located on a lower end face of the fifth rectangular metal block 28, a length of the sixth rectangular cavity 29 in the front-back direction and a length of the eighth rectangular cavity 31 in the front-back direction are equal to the length of the first rectangular cavity 8, the length of the sixth rectangular cavity 29 in the front-back direction is smaller than that of the seventh rectangular cavity 30 in the front-back direction, a third rectangular metal ridge 33 is arranged in the sixth rectangular cavity 29, a height of the third rectangular metal ridge 33 is smaller than half that of the sixth rectangular cavity 29, a length of the third rectangular metal ridge 33 in the front-back direction is smaller than half that of the sixth rectangular cavity 29 in the front-back direction, a distance between a front end face of the third rectangular metal ridge 33 and a front end face of the sixth rectangular cavity 29 is equal to a distance between a rear end face of the third rectangular metal ridge 33 and a rear end face of the sixth rectangular cavity 29, a left end face of the third rectangular metal ridge 33 is flush with the left end face of the sixth rectangular cavity 29, and a right end face of the third rectangular metal ridge 33 is flush with the right end face of the sixth rectangular cavity 29. A fourth rectangular metal ridge 34 is arranged in the eighth rectangular cavity 31, a height of the fourth rectangular metal ridge 34 is smaller than half that of the eighth rectangular cavity 31, a length of the fourth rectangular metal ridge 34 in the front-back direction is smaller than half that of the eighth rectangular cavity 31 in the front-back direction, a distance between a front end face of the fourth rectangular metal ridge 34 and a front end face of the eighth rectangular cavity 31 is equal to the distance between a rear end face of the fourth rectangular metal ridge 34 and the rear end face of the eighth rectangular cavity 31, a left end face of the fourth rectangular metal ridge 34 is flush with the left end face of the eighth rectangular cavity 31, and a right end face of the fourth rectangular metal ridge 34 is flush with the right end face of the eighth rectangular cavity 31. A first H-plane step 35 and a second H-plane step 36 are arranged in the seventh rectangular cavity 30, the first H-plane step 35 is located above the second H-plane step 36, the first H-plane step 35 and the second H-plane step 36 are both rectangular, an upper end face of the first H-plane step 35 is flush with an upper end face of the seventh rectangular cavity 30, a lower end face of the first H-plane step 35 is attached to the upper end face of the second H-plane step 36, a left end face of the first H-plane step 35 is attached to the left end face of the seventh rectangular cavity 30, a right end face of the first H-plane step 35 is attached to the right end face of the seventh rectangular cavity 30, a front end face of the first H-plane step 35 is attached to a front end face of the seventh rectangular cavity 30, a rear end face of the first H-plane step 35 is attached to a rear end face of the seventh rectangular cavity 30, a rear end face of the second H-plane step 36 is connected with the rear end face of the seventh rectangular cavity 30, a front end face of the second H-plane step 36 is connected with the front end face of the seventh rectangular cavity 30, a length of the second H-plane step 36 in the left-right direction is smaller than that of the seventh rectangular cavity 30 in the left-right direction, a distance between a left end face of the second H-plane step 36 and the left end face of the seventh rectangular cavity 30 is equal to a distance between a right end face of the second H-plane step 36 and the right end face of the seventh rectangular cavity 30, a height of the second H-plane step 36 is greater than that of the first H-plane step 35, and the height of the second H-plane step 36 is smaller than a quarter of a height of the seventh rectangular cavity 30. When two H-plane Y-type single-ridge waveguide power dividers 6 in each row are connected with one E-plane T-type single-ridge waveguide power divider 7, the right end face of the first rectangular cavity 8 of the H-plane Y-type single-ridge waveguide power divider 6 on a left side is in butt joint with the left end face of the sixth rectangular cavity 29 of the E-plane T-type single-ridge waveguide power divider 7, and the right end face of the first rectangular cavity 8 of the H-plane Y-type single-ridge waveguide power divider 6 on a right side is in butt joint with the right end face of the eighth rectangular cavity 31 of the E-plane T-type single-ridge waveguide power divider 7.

In this embodiment, the radiating layer 1 and the feed network layer 3 are mature products in respective technical fields.

Embodiment 2

This embodiment is basically identical with embodiment 1 and differs from the Embodiment 1 in the following aspects:

In this embodiment, the feed network layer 3 comprises a second metal plate 37 and a feed network disposed on the second metal plate 37. The feed network comprises two feed units 38 which are symmetrically arranged left and right, and the two feed units 38 are connected through an E-plane T-type rectangular-single ridge waveguide power divider 39. Each feed unit 38 comprises four single ridge waveguide-rectangular waveguide converters and three H-plane T-type single-ridge waveguide power dividers. The four single ridge waveguide-rectangular waveguide converters are sequentially arrayed at intervals from front to back, a first single ridge waveguide-rectangular waveguide converter 40 is connected with a second single ridge waveguide-rectangular waveguide converter 41 through a first H-plane T-type single-ridge waveguide power divider 42, a third single ridge waveguide-rectangular waveguide converter 43 is connected with a fourth single ridge waveguide-rectangular waveguide converter 44 through a second H-plane T-type single-ridge waveguide power divider 45, and the first H-plane T-type single-ridge waveguide power divider 42 is connected with the second H-plane T-type single-ridge waveguide power divider 45 through a third H-plane T-type single-ridge waveguide power divider 46. The third H-plane T-type single-ridge waveguide power dividers 46 in the two feed units 38 are connected with the E-plane T-type rectangular-single ridge waveguide power divider 39.

In this embodiment, the E-plane T-type rectangular-single ridge waveguide power divider 39 comprises a sixth rectangular metal block 391. A ninth rectangular cavity 47, a tenth rectangular cavity 48, an eleventh rectangular cavity 49, a twelfth rectangular cavity 50 and a thirteenth rectangular cavity 51 are sequentially formed in the sixth rectangular metal block 391 from left to right, the ninth rectangular cavity 47, the tenth rectangular cavity 48, the eleventh rectangular cavity 49, the twelfth rectangular cavity 50 and the thirteenth rectangular cavity 51 are sequentially communicated, a left end face of the ninth rectangular cavity 47 is flush with a left end face of the sixth rectangular metal block 391, a right end face of the ninth rectangular cavity 47 is flush with a left end face of the tenth rectangular cavity 48, a right end face of the tenth rectangular cavity 48 is flush with a left end face of the eleventh rectangular cavity 49, a right end face of the eleventh rectangular cavity 49 is flush with a left end face of the twelfth rectangular cavity 50, a right end face of the twelfth rectangular cavity 50 is flush with a left end face of the thirteenth rectangular cavity 51, and a right end face of the thirteenth rectangular cavity 51 is flush with a right end face of the sixth rectangular metal block 391. An upper end face of the ninth rectangular cavity 47, an upper end face of the tenth rectangular cavity 48, an upper end face of the eleventh rectangular cavity 49, an upper end face of the twelfth rectangular cavity 50 and an upper end face of the thirteenth rectangular cavity 51 are arranged on an upper end face of the sixth rectangular metal block 391. A lower end face of the ninth rectangular cavity 47, a lower end face of the tenth rectangular cavity 48, a lower end face of the eleventh rectangular cavity 49, a lower end face of the twelfth rectangular cavity 50 and a lower end face of the thirteenth rectangular cavity 51 are located on the same plane and are higher than a lower end face of the sixth rectangular metal block 391. A length of the ninth rectangular cavity 47 in the left-right direction is greater than that of the tenth rectangular cavity 48 in the left-right direction and is smaller than that of the eleventh rectangular cavity 49 in the left-right direction, the length of the ninth rectangular cavity 47 in the left-right direction is equal to that of the thirteenth rectangular cavity 51 in the left-right direction, and a length of the tenth rectangular cavity 48 is equal to that of the twelfth rectangular cavity 50 in the left-right direction. A front end face of the ninth rectangular cavity 47, a front end face of the tenth rectangular cavity 48, a front end face of the eleventh rectangular cavity 49, a front end face of twelfth rectangular cavity 50 and a front end face of the thirteenth rectangular cavity 51 are located on the same plane and are located behind a front end face of the sixth rectangular metal block 391. The length of the ninth rectangular cavity 47 in the front-back direction is smaller than that of the tenth rectangular cavity 48 in the front-back direction, the length of the tenth rectangular cavity 48 in the front-back direction is smaller than that of the eleventh rectangular cavity 49 in the front-back direction, the length of the ninth rectangular cavity 47 in the front-back direction is equal to that of the thirteenth rectangular cavity 51 in the front-back direction, and the length of the tenth rectangular cavity 48 in the front-back direction is equal to that of the twelfth rectangular cavity 50 in the front-back direction. A rear end face of the eleventh rectangular cavity 49 is located in front of a rear end face of the sixth rectangular metal block 391, and a second rectangular metal base plate 52, a third rectangular metal base plate 53, a fourth rectangular metal base plate 54, a fifth rectangular metal base plate 55 and a third H-plane step 56 are arranged in the eleventh rectangular cavity 49. A front end face of the second rectangular metal base plate 52, a front end face of the third rectangular metal base plate 53, a front end face of the fourth rectangular metal base plate 54 and a front end face of the fifth rectangular metal base plate 55 are attached to a front end of the eleventh rectangular cavity 49. A rear end face of the second rectangular metal base plate 52, a rear end face of the third rectangular metal base plate 53, a rear end face of the fourth rectangular metal base plate 54 and a rear end face of the fifth rectangular metal base plate 55 are attached to the rear end face of the eleventh rectangular cavity 49. The length of the second rectangular metal base plate 52 in the left-right direction is smaller than a quarter of a length of the eleventh rectangular cavity 49 in the left-right direction, the length of the second rectangular metal base plate 52 in the left-right direction is equal to that of the third rectangular metal base plate 53 in the left-right direction, a length of the fourth rectangular metal base plate 54 in the left-right direction is equal to that of the fifth rectangular metal base plate 55 in the left-right direction, a length of the fifth rectangular metal base plate 55 in the left-right direction is smaller than one fifth of a length of the third rectangular metal base plate 53 in the left-right direction, a height of the second rectangular metal base plate 52, a height of the third rectangular metal base plate 53, a height of the fourth rectangular metal base plate 54 and a height of the fifth rectangular metal base plate 55 are equal and are smaller than one tenth of a height of the eleventh rectangular cavity 49, a lower end face of the second rectangular metal base plate 52 and the lower end face of the third rectangular metal base plate are attached to the lower end face of the eleventh rectangular cavity 49, the fourth rectangular metal base plate 54 is attached to an upper surface of the second rectangular metal base plate 52, a right end face of the fourth rectangular metal base plate 54 is flush with a right end face of the second rectangular metal base plate 52, the length of the fourth rectangular metal base plate 54 in the left-right direction is smaller than one fifth of the length of the second rectangular metal base plate 52 in the left-right direction, the fifth rectangular metal base plate 55 is attached to an upper surface of the third rectangular metal base plate 53, a left end face of the fifth rectangular metal base plate 55 is flush with a left end face of the third rectangular metal base plate 53, the second rectangular metal base plate 52 is located on a left side of a vertical plane where a center line of the eleventh rectangular cavity 49 in the left-right direction is located, a distance from the right end face of the second rectangular metal base plate 52 to the vertical plane where the center line of the eleventh rectangular cavity 49 in the left-right direction is located is half of a width of a standard waveguide port WR-28, the third rectangular base plate 53 is located on a right side of the vertical plate where the center line of the eleventh rectangular cavity 49 in the left-right direction is located, a distance from the left end face of the third rectangular metal base plate 53 to the vertical plane where the center line of the eleventh rectangular cavity 49 in the left-right direction is located is half of a width of the standard waveguide port WR-28, a front end face of the third H-plane step 56 is attached to the front end face of the eleventh rectangular cavity 49, a rear end face of the third H-plane step 56 is attached to the rear end face of the eleventh rectangular cavity 49, an upper end face of the third H-plane step 56 is flush with the upper end face of the sixth rectangular metal block 391, a vertical plane where a center line of the third H-plane step 56 in the left-right direction is located coincides with the vertical plane where the center line of the eleventh rectangular cavity 49 in the left-right direction is located, a width of the third H-plane step 56 in the left-right direction is smaller than that of the standard waveguide port WR-28, and a height of the third H-plane step 56 is smaller than half that of the eleventh rectangular cavity 49. A first ridge step 57 is arranged in the ninth rectangular cavity 47, a second ridge step 58 is arranged in the tenth rectangular cavity 48, a third ridge step 59 and a fourth ridge step 60 are arranged in the eleventh rectangular cavity 49, a fifth ridge step 61 is arranged in the twelfth rectangular cavity 50, a sixth ridge step 62 is arranged in the thirteenth rectangular cavity 51, and the first ridge step 57, the second ridge step 58, the third ridge step 59, the fourth ridge step 60, the fifth ridge step 61 and the sixth ridge step 62 are all rectangular. A left end face of the first ridge step 57 is flush with the left end face of the ninth rectangular cavity 47, a right end face of the first ridge step 57 is flush with a right end face of the ninth rectangular cavity 47, a height of the first ridge step 57 is smaller than that of the ninth rectangular cavity 47, a length of the first ridge step 57 in the front-back direction is smaller than that of the ninth rectangular cavity 47 in the front-back direction, a distance between a front end face of the first ridge step 57 and the front end face of the ninth rectangular cavity 47 is equal to a distance between a rear end face of the first ridge step 57 and a rear end face of the ninth rectangular cavity 47, a left end face of the second ridge step 58 is attached to the right end face of the first ridge step 57, a right end face of the second ridge step 58 is flush with the right end face of the tenth rectangular cavity 48, a front end face of the second ridge step 58 is flush with the front end face of the first ridge step 57, a rear end face of the second ridge step 58 is flush with the rear end face of the first ridge step 57, a height of the second ridge step 58 is smaller than that of the first ridge step 57, a left end face of the third ridge step 59 is attached to the right end face of the second ridge step 58, a right end face of the third ridge step 59 is located in the eleventh rectangular cavity 49, the right end face of the third ridge step 59 is spaced from a left end face of the second rectangular metal base plate 52 by a certain distance which is smaller than the length of the second rectangular metal base plate 52 in the left-right direction, a front end face of the third ridge step 59 is flush with the front end face of the second ridge step 58, a rear end face of the third ridge step 59 is flush with the rear end face of the second ridge step 58, a height of the third ridge step 59 is smaller than that of the second ridge step 58, a right end face of the fourth ridge step 60 is flush with the right end face of the thirteenth rectangular cavity 51, a left end face of the fourth ridge step 60 is flush with the left end face of the thirteenth rectangular cavity 51, a height of the fourth ridge step 60 is equal to that of the first ridge step 57, a length of the fourth ridge step 60 in the front-back direction is equal to that of the first ridge step 57 in the front-back direction, a distance between a front end face of the fourth ridge step 60 and the front end face of the thirteenth rectangular cavity 51 is equal to a distance between a rear end face of the fourth ridge step 60 and a rear end face of the thirteenth rectangular cavity 51, a right end face of the fifth ridge step 61 is attached and connected to the left end face of the fourth ridge step 60, a left end face of the fifth ridge step 61 is flush with the left end face of the twelfth rectangular cavity 50, a front end face of the fifth ridge step 61 is flush with the front end face of the fourth ridge step 60, a rear end face of the fifth ridge step 61 is flush with the rear end face of the fourth ridge step 60, a height of the fifth ridge step 61 is equal to that of the second ridge step 58, a right end face of the sixth ridge step 62 is attached to the left end face of the fifth ridge step 61, a left end face of the sixth ridge step 62 is located in the eleventh rectangular cavity 49, the left end face of the sixth ridge step 62 is spaced from a right end face of the third rectangular metal base plate 53 by a certain distance which is smaller than the length of the third rectangular metal base plate 53 in the left-right direction, a front end face of the sixth ridge step 62 is flush with the front end face of the fifth ridge step 61, a rear end face of the sixth ridge step 62 is flush with the rear end face of the fifth ridge step 61, a height of the sixth ridge step 62 is equal to that of the third ridge step 59, a rectangular waveguide input port 63 communicated with the eleventh rectangular cavity 49 is formed in the sixth rectangular metal block 391, a lower end of the rectangular waveguide input port 63 is located on the lower end face of the sixth rectangular metal block 391, an upper end of the rectangular waveguide input port 63 is communicated with the lower end face of the eleventh rectangular cavity 49, a front end face of the rectangular waveguide input port 63 is flush with the front end face of the eleventh rectangular cavity 49, a rear end face of the rectangular waveguide input port 63 is flush with the rear end face of the eleventh rectangular cavity 49, a left end face of the rectangular waveguide input port 63 is flush with the right end face of the second rectangular metal base plate 52, and a right end face of the rectangular waveguide input port 63 is flush with the left end face of the third rectangular metal base plate 53. A first output port of the E-plane T-type rectangular-single ridge waveguide power divider 39 is formed in the left end face of the ninth rectangular cavity 47, a second output port of the E-plane T-type rectangular-single ridge waveguide power divider 39 is formed in the right end face of the thirteenth rectangular cavity 51, and output ports of the E-plane T-type rectangular-single ridge waveguide power divider 39 are in butt joint with the H-plane T-type single-ridge waveguide power divider.

In this embodiment, the H-plane T-type single-ridge waveguide power divider comprises a seventh rectangular block 64. A fourteenth rectangular cavity 65 and a fifteenth rectangular cavity 66 are formed in the seventh rectangular metal block 64, the fourteenth rectangular cavity 65 is communicated with the fifteenth rectangular cavity 66, a front end face of the fourteenth rectangular cavity 65 is flush with a front end face of the seventh rectangular metal block 64, a rear end face of the seventh rectangular metal block 64 is flush with the front end face of the seventh rectangular metal block 64, a left end face of the fifteenth rectangular cavity 66 is flush with a left end face of the seventh rectangular metal block 64, a right end face of the fifteenth rectangular cavity 66 is flush with a left end face of the fourteenth rectangular cavity 65, a center line of the fifteenth rectangular cavity 66 in the front-back direction and a center line of the seventh rectangular metal block 64 in the front-back direction are located on the same vertical plane, an upper end face of the fourteenth rectangular cavity 65 and an upper end face of the fifteenth rectangular cavity 66 are flush with an upper end face of the seventh rectangular metal block 64, and a height of the fourteenth rectangular cavity 65 is equal to that of the fifteenth rectangular cavity 66. A fifth rectangular metal ridge 67, a sixth rectangular metal base plate 68 and a sixth rectangular metal ridge 69 are sequentially arranged in the fourteenth rectangular cavity 65 from front to back. A front end face of the fifth rectangular metal ridge 67 is flush with the front end face of the fourteenth rectangular cavity 65, a rear end face of the fifth rectangular metal ridge 67 is flush with a front end face of the fifteenth rectangular cavity 66, a rear end face of the sixth rectangular metal ridge 69 is flush with a rear end face of the fourteenth rectangular cavity 65, a front end face of the sixth rectangular metal ridge 69 is flush with a rear end face of the fifteenth rectangular cavity 66, a height of the fifth rectangular metal ridge 67 is equal to that of the sixth rectangular metal ridge 69 and is equal to half that of the fourteenth rectangular cavity 65, a length of the fifth rectangular metal ridge 67 in the left-right direction is equal to that of the sixth rectangular metal ridge 69 in the left-right direction, the length of the fifth rectangular metal ridge 67 in the left-right direction is smaller than a quarter of a length of the fourteenth rectangular cavity 65 in the left-right direction, a left end face of the fifth rectangular metal ridge 67 is flush with a left end face of the sixth rectangular metal ridge 69, a right end face of the fifth rectangular metal ridge 67 is flush with a right end face of the sixth rectangular metal ridge 69, a front end face of the sixth rectangular metal base plate 68 makes contact with the rear end face of the fifth rectangular metal ridge 67, a rear end face of the sixth rectangular metal base plate 68 makes contact with the front end face of the sixth rectangular metal ridge 69, a left end face of the sixth rectangular metal base plate 68 is flush with the left end face of the fourteenth rectangular cavity 65, a right end face of the sixth rectangular metal base plate 68 is flush with a right end face of the fourteenth rectangular cavity 65, a height of the sixth rectangular metal base plate 68 is smaller than a quarter of the height of the fourteenth rectangular cavity 65, a seventh rectangular metal ridge 70 is arranged in the fifteenth rectangular cavity 66, a left end face of the seventh rectangular metal ridge 70 is flush with the left end face of the fifteenth rectangular cavity 66, a right end face of the seventh rectangular metal ridge 70 makes contact with the left end face of the sixth rectangular metal base plate 68, a length of the seventh rectangular metal ridge 70 in the front-back direction is equal to that of the fifth rectangular metal ridge 67 in the left-right direction, a distance between a front end face of the seventh rectangular meal ridge 70 and the front end face of the fifteenth rectangular cavity 66 is equal to a distance between a rear end face of the seventh rectangular metal ridge 70 and the rear end face of the fifteenth rectangular cavity 66, a length of the fifteenth rectangular cavity 66 in the left-right direction is equal to that of the ninth rectangular cavity 47 in the front-back direction, the left end face of the fifteenth rectangular cavity 66 in the H-plane T-type single-ridge waveguide power divider is in butt joint with the output ports of the E-plane T-type rectangular-single ridge waveguide power divider 39, and a left end face and a right end face of the H-plane T-type single-ridge waveguide power divider are in butt joint with the corresponding single ridge waveguide-rectangular waveguide converters.

In this embodiment, the single ridge waveguide-rectangular waveguide converter comprises an eighth rectangular metal block 71, a sixteenth rectangular cavity 72 is formed in the eighth rectangular metal block 71, a first E-plane step 73 is arranged on a left side of the sixteenth rectangular cavity 72 and is rectangular, a height of the first E-plane step 73 is smaller than that of the sixteenth rectangular cavity 72, the first E-plane step 73 is connected with a front end face, a rear end face and a left end face of the sixteenth rectangular cavity 72, a fourth H-plane step 74 is arranged on the right side of the sixteenth rectangular cavity 72 and is connected with a right end face and a rear end face of the sixteenth rectangular cavity 72, a height of the fourth H-plane step 74 is equal to that of the sixteenth rectangular cavity 72, a rectangular waveguide output port 75 communicated with the sixteenth rectangular cavity 72 is formed in an upper surface of the eighth rectangular metal block 71, a single-ridge waveguide input port 76 is formed in a front side face of the eighth rectangular metal block 71 and is communicated with the sixteenth rectangular cavity 72, a height of the single-ridge waveguide input port 76 is equal to that of the sixteenth rectangular cavity 72, a bottom surface of the single-ridge waveguide input port 76 and a bottom surface of the sixteenth rectangular cavity 72 are located on the same plane, a first ridge step extending onto the bottom surface of the sixteenth rectangular cavity 72 is arranged on the bottom surface of the single-ridge waveguide input port 76, and comprises a first rectangular ridge 77 and a second rectangular ridge 78 which are sequentially connected, a height of the first rectangular ridge 77 is greater than that of the second rectangular ridge 78, the height of the first rectangular ridge 77 is smaller than that of the sixteenth rectangular cavity 72, a size of the single-ridge waveguide input port 76 is matched with that of the left end face of the fourteenth rectangular cavity 65 in the H-plane T-type single-ridge waveguide power divider, the single-ridge waveguide input port 76 is in butt joint with the left end face or the right end face of the fourteenth rectangular cavity 65 in the H-plane T-type single-ridge waveguide power divider.

Figure 10:
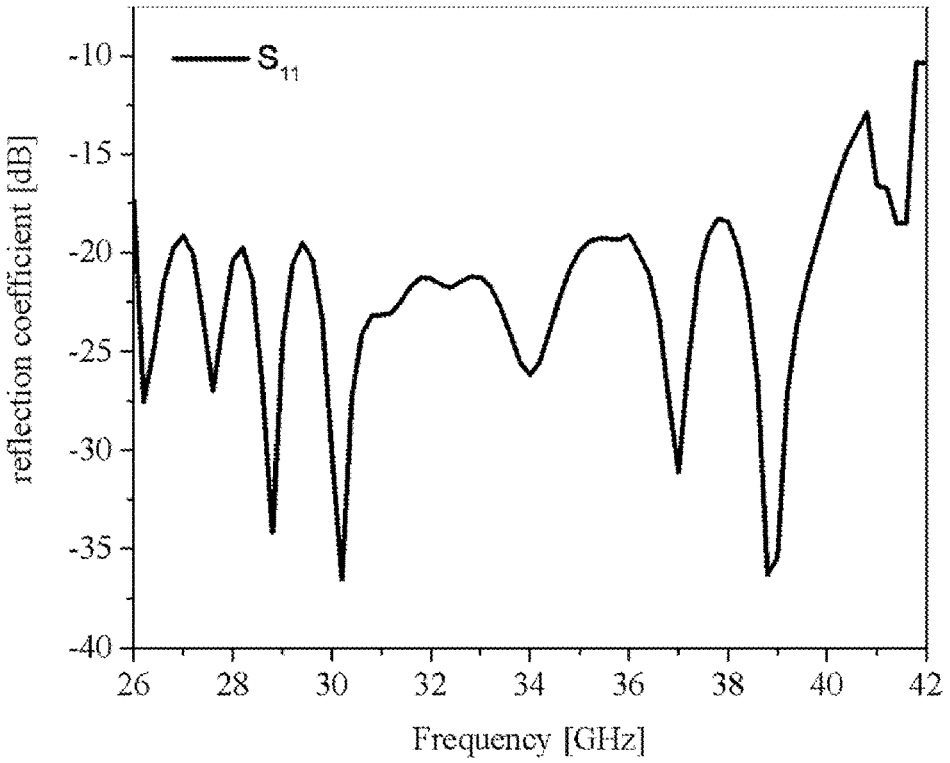
FIG. 10 is a curve chart of a return loss of the ultra-wideband CTS flat-plate array antenna from 25 GHz to 43 GHz of the invention.

FIG. 10 shows a curve chart of a return loss of the ultra-wideband CTS flat-plate array antenna from 25 GHz to 43 GHz of the invention. As can be seen from FIG. 10, within the range from 26 GHz to 42 GHz (relative bandwidth 47.1%), a return loss of the ultra-wideband CTS flat-plate array antenna is lower than −10 dB, and thus, an ultra-bandwidth objective is fulfilled.

Figure 11:
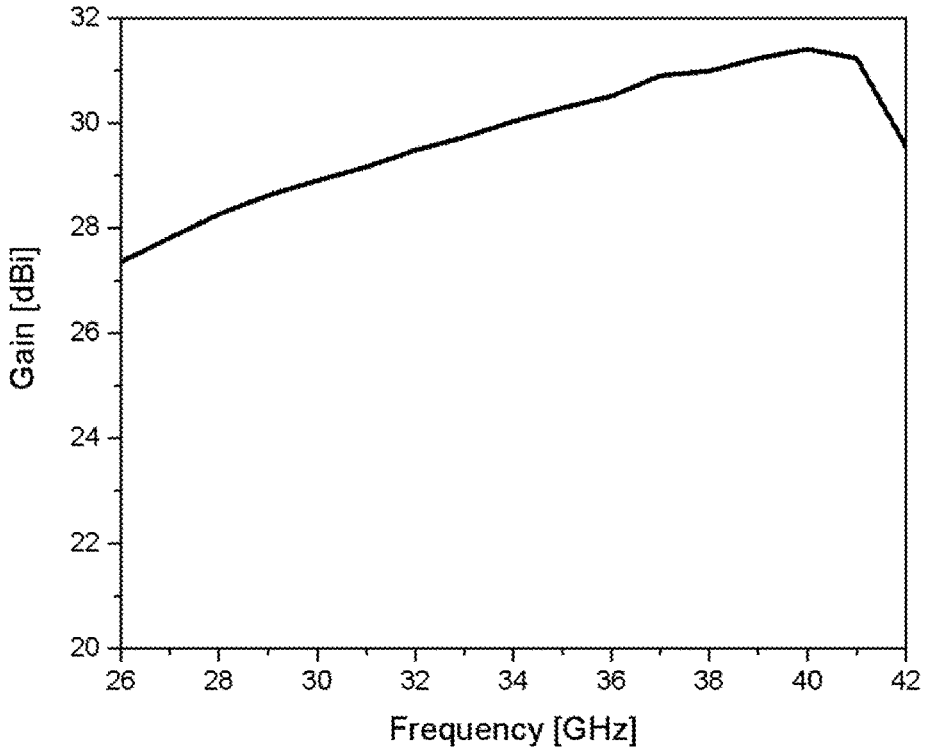
FIG. 11 is an E-plane and H-plane direction diagram of the ultra-wideband CTS flat-plate array antenna at 37 GHz of the invention.

FIG. 11 shows an E-plane and H-plane direction diagram of the ultra-wideband CTS flat-plate array antenna at 37

GHz of the invention. As can be seen from FIG. 11, a gain of the ultra-wideband CTS flat-plate array antenna at 37 GHz within the whole frequency band is superior to 27 dBi, and a high gain is realized.

What is claimed is:

1. An ultra-wideband CTS flat-plate array antenna, comprising a radiating layer, a mode switching layer and a feed network layer which are sequentially arrayed from top to bottom, wherein the mode switching layer comprises a first metal plate and a mode switching cavity formed in the first metal plate, and the mode switching cavity comprises two mode switching units which are identical in structure and are arranged left and right in a spaced manner; each mode switching unit comprises eight H-plane Y-type single-ridge waveguide power dividers which are arrayed in 4 rows and 2 columns, wherein the H-plane Y-type single-ridge waveguide power divider in the $m^{th}$ row and $1^{st}$ column is bilaterally symmetrical with the H-plane Y-type single-ridge waveguide power divider in the $m^{th}$ row and $2^{nd}$ column, and m=1, 2, 3 and 4; the two H-plane Y-type single-ridge waveguide power dividers in each row are connected through an E-plane T-type single-ridge waveguide power divider, and a center distance between every two adjacent H-plane Y-type single-ridge waveguide power dividers in each column is not over one wavelength; the H-plane Y-type single-ridge waveguide power divider in the $m^{th}$ row and $1^{st}$ column comprises a first rectangular cavity, an isosceles-trapezoid cavity, a second rectangular cavity, a third rectangular cavity, a fourth rectangular cavity and a fifth rectangular cavity which are sequentially formed in an upper end face of the first metal plate from right to left, the first rectangular cavity, the isosceles-trapezoid cavity, the second rectangular cavity, the third rectangular cavity, the fourth rectangular cavity and the fifth rectangular cavity are sequentially communicated front and back, are identical in height and are lower than the first metal plate, and center lines of the first rectangular cavity, the isosceles-trapezoid cavity, the second rectangular cavity, the third rectangular cavity, the fourth rectangular cavity and the fifth rectangular cavity in a front-back direction are located on the same straight line; a length direction of the first rectangular cavity, the second rectangular cavity, the third rectangular cavity, the fourth rectangular cavity and the fifth rectangular cavity is defined as a front-back direction of the first metal plate, and a width direction of the first rectangular cavity, the second rectangular cavity, the third rectangular cavity, the fourth rectangular cavity and the fifth rectangular cavity is defined as a left-right direction of the first metal plate; a right end face of the isosceles-trapezoid cavity is parallel to a left end face of the isosceles-trapezoid cavity and is smaller than the left end face of the isosceles-trapezoid cavity in size, and a front end face of the isosceles-trapezoid cavity is equal to a rear end face of the isosceles-trapezoid cavity; a right end face of the first rectangular cavity is flush with the left end face of the isosceles-trapezoid cavity, a length of the first rectangular cavity is smaller than that of the right end face of the isosceles-trapezoid cavity in the front-back direction of the first metal plate, the left end face of the isosceles-trapezoid cavity overlaps with a right end face of the second rectangular cavity and is as large as the right end face of the second rectangular cavity, a left end face of the second rectangular cavity is flush with a right end face of the third rectangular cavity, a length of the third rectangular cavity is greater than that of the second rectangular cavity, a left end face of the third rectangular cavity is flush with a right end face of the fourth rectangular cavity, a length of the fourth rectangular cavity is greater than that of the third rectangular cavity, a left end face of the fourth rectangular cavity is flush with a right end face of the fifth rectangular cavity, and a length of the fifth rectangular cavity is greater than that of the fourth rectangular cavity; a first rectangular metal ridge is arranged in the first rectangular cavity, a right end face of the first rectangular metal ridge is flush with the right end face of the first rectangular cavity, a left end face of the first rectangular metal ridge is flush with the left end face of the first rectangular cavity, a height of the first rectangular metal ridge is half that of the first rectangular cavity, a length of the first rectangular metal ridge in the front-back direction of the first metal plate is smaller than a quarter of the length of the first rectangular cavity, and a distance between the front end face of the first rectangular metal ridge and a front end face of the first rectangular cavity is equal to a distance between the rear end face of the first rectangular metal ridge and a rear end face of the first rectangular cavity; a first rectangular metal base plate and a second rectangular metal ridge are arranged in the isosceles-trapezoid cavity, a height of the first rectangular metal base plate is smaller than a quarter of a height of the isosceles-trapezoid cavity, a right end face of the first rectangular metal base plate is flush with the right end face of the isosceles-trapezoid cavity, a left end face of the first rectangular metal base plate is located in the second rectangular cavity, a length of the first rectangular metal base plate in the front-back direction of the first metal plate is greater than that of the first rectangular cavity and is smaller than that of the right end face of the isosceles-trapezoid cavity in the front-back direction of the first metal base plate, a distance between a front end face of the first rectangular metal base plate and a front end face of the second rectangular cavity is equal to a distance between the rear end face of the first rectangular metal base plate and a rear end face of the second rectangular cavity, a lower end face of the second rectangular metal ridge is attached to an upper end face of the first rectangular metal base plate, a right end face of the second rectangular metal ridge is flush with the left end face of the first rectangular metal ridge, an upper end face of the second rectangular metal ridge and an upper end face of the first rectangular metal ridge are located on the same plane, a length of the second rectangular metal ridge in the left-right direction of the first metal plate is not greater than a quarter of a length of the isosceles-trapezoid cavity in the left-right direction of the first metal plate; a first metal cylinder is arranged on the first rectangular metal base plate, a lower end face of the first metal cylinder is attached to the upper end face of the first rectangular metal base plate, a center of the first metal cylinder is located on a center line of the upper end face of the first rectangular metal base plate in the left-right direction of the first metal plate and is also located on the left end face of the isosceles-trapezoid cavity, a diameter of the first metal cylinder is smaller than a width of the first rectangular metal ridge and is greater than 0.5 mm, and a height of the first metal cylinder is smaller than a quarter of the height of the isosceles-trapezoid cavity; a first rectangular metal baffle is arranged in the second rectangular cavity, a right end face of the first rectangular metal baffle is flush with the left end face of the first rectangular metal base plate, a left end face of the first rectangular metal baffle is flush with the left end face of the second rectangular cavity, a length of the first rectangular metal baffle in the front-back direction of the first metal plate is smaller than that of the first rectangular metal base plate in the front-back direction of the first metal plate and is greater than that of the first rectangular metal ridge in the front-back direction of the first metal plate, the length of the first rectangular metal baffle in the left-right direction of the first metal plate is smaller than half of a width of the second rectangular cavity, a height of the first rectangular metal baffle is equal to that of the second rectangular cavity, and a distance between the front end face of the first rectangular metal baffle and the front end face of the second rectangular cavity is equal to a distance between the rear end face of the first rectangular metal baffle and the rear end face of the second rectangular cavity; a second rectangular metal baffle is arranged in the third rectangular cavity, a right end face of the second rectangular metal baffle is flush with the right end face of the first rectangular metal baffle, a left end face of the second rectangular metal baffle is flush with a left end face of the third rectangular cavity, a length of the second rectangular metal baffle in the front-back direction of the first metal plate is smaller than that of the first rectangular metal baffle in the front-back direction of the first metal plate and is greater than half that of the first rectangular metal baffle in the front-back direction of the first metal plate, a height of the second rectangular metal baffle is equal to that of the third rectangular cavity, and a distance between the front end face of the second rectangular metal baffle and the front end face of the third rectangular cavity is equal to a distance between a rear end face of the second rectangular metal baffle and the rear end face of the third rectangular cavity; a third rectangular metal baffle is arranged in the fourth rectangular cavity, a right end face of the third rectangular metal baffle is flush with the rear end face of the second rectangular metal baffle, a left end face of the third rectangular metal baffle is flush with the left end face of the fourth rectangular cavity, a height of the third rectangular metal baffle is equal to that of the fourth rectangular cavity, a length of the third rectangular metal baffle in the front-back direction of the first metal plate is smaller than the diameter of the first metal cylinder and is greater than 0.5 mm, a distance between the front end face of the third rectangular metal baffle and the front end face of the fourth rectangular cavity is equal to a distance between the rear end face of the third rectangular metal baffle and a rear end face of the fourth rectangular cavity, a second metal cylinder is arranged in the fifth rectangular cavity, a diameter of the second metal cylinder is equal to that of the first metal cylinder, a height of the second metal cylinder is smaller than half that of the fifth rectangular cavity, and a center of the second metal cylinder and a center of the fifth rectangular cavity are located on the same straight line; the H-plane Y-type single-ridge waveguide power divider further comprises a first ridge assembly and a second ridge assembly which are symmetrically arranged in the front-back direction of the first metal plate, and the first ridge assembly comprises a first right-trapezoid metal block, a second right-trapezoid metal block, a first rectangular metal block, a second rectangular metal block, a third rectangular metal block and a fourth rectangular metal block; the first rectangular metal block is located on the first rectangular metal base plate, a lower end face of the first rectangular metal block is attached to the upper end face of the first rectangular metal base plate, a front end face of the first rectangular metal block is flush with the front end face of the first rectangular metal base plate, a length of the first rectangular metal block in the front-back direction of the first metal plate is smaller than one tenth of the length of the first rectangular metal base plate in the front-back direction of the first metal plate, the length of the first rectangular metal block in the left-right direction of the first metal plate is equal to that of the first rectangular metal ridge in the front-back direction of the first metal plate, a sum of a height of the first rectangular metal block and the height of the first rectangular metal base plate is equal to the height of the first rectangular metal ridge, and a distance between the right end face of the first rectangular metal block and the right end face of the first rectangular metal base plate is equal to a distance between the left end face of the first rectangular metal block and the left end face of the first rectangular metal base plate; the first right-trapezoid metal block and the second right-trapezoid metal block are located in the isosceles-trapezoid cavity, the first right-trapezoid metal block is located in front of the first rectangular metal block, a left end face of the first right-trapezoid metal block is parallel to a right end face of the first right-trapezoid metal block, the right end face of the first right-trapezoid metal block is smaller than the left end face of the first right-trapezoid metal block, a rear end face of the first right-trapezoid metal block, the front end face of the first rectangular metal base plate and the front end face of the first rectangular metal block are connected and are located on the same plane, a front end face of the first right-trapezoid metal block is parallel to the front end face of the isosceles-trapezoid cavity, a height of the first right-trapezoid metal block is equal to that of the first rectangular metal ridge, a lower end face of the first right-trapezoid metal block is attached to a lower end face of the isosceles-trapezoid cavity, the second right-trapezoid metal block is located on a left side of the first right-trapezoid metal block, a right end face of the second right-trapezoid metal block and the left end face of the first right-trapezoid metal block are connected and are located on the same plane, a left end face of the second right-trapezoid metal block is parallel to the right end face of the second right-trapezoid metal block, the right end face of the second right-trapezoid metal block is smaller than the left end face of the second right-trapezoid metal block, a front end face of the second right-trapezoid metal block and the front end face of the first right-trapezoid metal block are connected and are located on the same plane, a length of the left end face of the second right-trapezoid metal block in the front-back direction of the first metal plate is equal to that of the first right-trapezoid metal block in the left-right direction of the first metal plate, a height of the second right-trapezoid metal block is equal to that of the first rectangular metal ridge, and a lower end face of the second right-trapezoid metal block is attached to the lower end face of the isosceles-trapezoid cavity; a right end face of the second rectangular metal block overlaps the left end face of the second right-trapezoid metal block, a left end face of the second rectangular metal block is located in the third rectangular cavity, a distance between front end face of the second rectangular metal block and the front end face of the second rectangular cavity is equal to a distance between the rear end face of the second rectangular metal block and the front end face of the second rectangular metal baffle, a height of the second rectangular metal block is equal to that of the first rectangular metal ridge, a length of a part, located in the third rectangular cavity, of the second rectangular metal block in the left-right direction of the first metal plate is not greater than one third of a width of the third rectangular cavity, and a lower end face of the second rectangular metal block is attached to a lower end face of the second rectangular cavity and a lower end face of the third rectangular cavity; a right end face of the third rectangular metal block overlaps a left end face of the second rectangular block, a left end face of the third rectangular metal block is located in the fourth rectangular cavity, a length of a part, located in the fourth rectangular cavity, of the third rectangular metal block in the left-right direction of the first metal plate is not greater than one fifth of the width of the fourth rectangular cavity, and a height of the third rectangular metal block is smaller than that of the second rectangular metal block and is greater than half that of the second rectangular metal block; a right end face of the fourth rectangular metal block overlaps the left end face of the third rectangular metal block, a rear end face of the fourth rectangular metal block is located in the fifth rectangular cavity, and a length of a part, located in the fifth rectangular cavity, of the fourth rectangular metal block in the left-right direction of the first metal plate is greater than half of a width of the fifth rectangular cavity, and a height of the fourth rectangular metal block is smaller than that of the third rectangular metal block and is greater than half that of the third rectangular metal block.

2. The ultra-wideband CTS flat-plate array antenna according to claim 1, wherein the E-plane T-type single-ridge waveguide power divider comprises a fifth rectangular metal block, wherein a sixth rectangular cavity, a seventh rectangular cavity and an eighth rectangular cavity are sequentially formed in an upper surface of the fifth rectangular metal block from left to right, and the sixth rectangular cavity, the seventh rectangular cavity and the eighth rectangular cavity are sequentially communicated, are identical in height and are as high as the first rectangular cavity; a center line of the sixth rectangular cavity in a left-right direction, a center line of the seventh rectangular cavity in the left-right direction and a center line of the eighth rectangular cavity in the left-right direction are located on the same straight line, a left end face of the sixth rectangular cavity is located on a left end face of the fifth rectangular metal block, a right end face of the sixth rectangular cavity is flush with a left end face of the seventh rectangular cavity, a right end face of the seventh rectangular cavity is flush with a left end face of the eighth rectangular cavity, a right end face of the eighth rectangular cavity is located on a right end face of the fifth rectangular metal block, a rectangular waveguide port is formed below the seventh rectangular cavity, an upper end face of the rectangular waveguide port overlaps a lower end face of seventh rectangular cavity, a lower end face of the rectangular waveguide port is located on a lower end face of the fifth rectangular metal block, a length of the sixth rectangular cavity in the front-back direction and a length of the eighth rectangular cavity in the front-back direction are equal to the length of the first rectangular cavity, the length of the sixth rectangular cavity in the front-back direction is smaller than that of the seventh rectangular cavity in the front-back direction, a third rectangular metal ridge is arranged in the sixth rectangular cavity, a height of the third rectangular metal ridge is smaller than half that of the sixth rectangular cavity, a length of the third rectangular metal ridge in the front-back direction is smaller than half that of the sixth rectangular cavity in the front-back direction, a distance between a front end face of the third rectangular metal ridge and a front end face of the sixth rectangular cavity is equal to a distance between a rear end face of the third rectangular metal ridge and a rear end face of the sixth rectangular cavity, a left end face of the third rectangular metal ridge is flush with the left end face of the sixth rectangular cavity, and a right end face of the third rectangular metal ridge is flush with the right end face of the sixth rectangular cavity; a fourth rectangular metal ridge is arranged in the eighth rectangular cavity, a height of the fourth rectangular metal ridge is smaller than half that of the eighth rectangular cavity, a length of the fourth rectangular metal ridge in the front-back direction is smaller than half that of the eighth rectangular cavity in the front-back direction, a distance between a front end face of the fourth rectangular metal ridge and a front end face of the eighth rectangular cavity is equal to a distance between a rear end face of the fourth rectangular metal ridge and a rear end face of the eighth rectangular cavity, a left end face of the fourth rectangular metal ridge is flush with the left end face of the eighth rectangular cavity, and a right end face of the fourth rectangular metal ridge is flush with the right end face of the eighth rectangular cavity; a first H-plane step and a second H-plane step are arranged in the seventh rectangular cavity, the first H-plane step is located above the second H-plane step, the first H-plane step and the second H-plane step are both rectangular, an upper end face of the first H-plane step is flush with an upper end face of the seventh rectangular cavity, a lower end face of the first H-plane step is attached to an upper end face of the second H-plane step, a left end face of the first H-plane step is attached to the left end face of the seventh rectangular cavity, a right end face of the first H-plane step is attached to the right end face of the seventh rectangular cavity, a front end face of the first H-plane step is attached to a front end face of the seventh rectangular cavity, a rear end face of the first H-plane step is attached to a rear end face of the seventh rectangular cavity, a rear end face of the second H-plane step is connected with the rear end face of the seventh rectangular cavity, a front end face of the second H-plane step is connected with the front end face of the seventh rectangular cavity, a length of the second H-plane step in the left-right direction is smaller than that of the seventh rectangular cavity in the left-right direction, a distance between a left end face of the second H-plane step and the left end face of the seventh rectangular cavity is equal to a distance between a right end face of the second H-plane step and the right end face of the seventh rectangular cavity, a height of the second H-plane step is greater than that of the first H-plane step, and the height of the second H-plane step is smaller than a quarter of a height of the seventh rectangular cavity; when two H-plane Y-type single-ridge waveguide power dividers in each row are connected with one E-plane T-type single-ridge waveguide power divider, the right end face of the first rectangular cavity of the H-plane Y-type single-ridge waveguide power divider on a left side is in butt joint with the left end face of the sixth rectangular cavity of the E-plane T-type single-ridge waveguide power divider, and the right end face of the first rectangular cavity of the H-plane Y-type single-ridge waveguide power divider on a right side is in butt joint with the right end face of the eighth rectangular cavity of the E-plane T-type single-ridge waveguide power divider.

3. The ultra-wideband CTS flat-plate array antenna according to claim 1, wherein the feed network layer comprises a second metal plate and a feed network disposed on the second metal plate, the feed network comprises two feed units which are symmetrically arranged left and right, and the two feed units are connected through an E-plane T-type rectangular-single ridge waveguide power divider; each of the feed units comprise four single ridge waveguide-rectangular waveguide converters and three H-plane T-type single-ridge waveguide power dividers, wherein the four single ridge waveguide-rectangular waveguide converters are sequentially arrayed at intervals from front to back, a first single ridge waveguide-rectangular waveguide converter is connected with a second single ridge waveguide-rectangular waveguide converter through a first H-plane T-type single-ridge waveguide power divider, a third single ridge waveguide-rectangular waveguide converter is connected with a fourth single ridge waveguide-rectangular waveguide converter through a second H-plane T-type single-ridge waveguide power divider, and the first H-plane T-type single-ridge waveguide power divider is connected with the second H-plane T-type single-ridge waveguide power divider through a third H-plane T-type single-ridge waveguide power divider, and the third H-plane T-type single-ridge waveguide power dividers in the two feed units are connected with the E-plane T-type rectangular-single ridge waveguide power divider.

4. The ultra-wideband CTS flat-plate array antenna according to claim 3, wherein the E-plane T-type rectangular-single ridge waveguide power divider comprises a sixth rectangular metal block, wherein a ninth rectangular cavity, a tenth rectangular cavity, an eleventh rectangular cavity, a twelfth rectangular cavity and a thirteenth rectangular cavity are sequentially formed in the sixth rectangular metal block from left to right, the ninth rectangular cavity, the tenth rectangular cavity, the eleventh rectangular cavity, the twelfth rectangular cavity and the thirteenth rectangular cavity are sequentially communicated, a left end face of the ninth rectangular cavity is flush with a left end face of the sixth rectangular metal block, a right end face of the ninth rectangular cavity is flush with a left end face of the tenth rectangular cavity, a right end face of the tenth rectangular cavity is flush with a left end face of the eleventh rectangular cavity, a right end face of the eleventh rectangular cavity is flush with a left end face of the twelfth rectangular cavity, a right end face of the twelfth rectangular cavity is flush with a left end face of the thirteenth rectangular cavity, and a right end face of the thirteenth rectangular cavity is flush with a right end face of the sixth rectangular metal block; an upper end face of the ninth rectangular cavity, an upper end face of the tenth rectangular cavity, an upper end face of the eleventh rectangular cavity, an upper end face of the twelfth rectangular cavity and an upper end face of the thirteenth rectangular cavity are arranged on an upper end face of the sixth rectangular metal block; a lower end face of the ninth rectangular cavity, a lower end face of the tenth rectangular cavity, a lower end face of the eleventh rectangular cavity, a lower end face of the twelfth rectangular cavity and a lower end face of the thirteenth rectangular cavity are located on the same plane and are higher than a lower end face of the sixth rectangular metal block; a length of the ninth rectangular cavity in the left-right direction is greater than that of the tenth rectangular cavity in the left-right direction and is smaller than that of the eleventh rectangular cavity in the left-right direction, the length of the ninth rectangular cavity in the left-right direction is equal to that of the thirteenth rectangular cavity in the left-right direction, and a length of the tenth rectangular cavity is equal to that of the twelfth rectangular cavity in the left-right direction; a front end face of the ninth rectangular cavity, a front end face of the tenth rectangular cavity, a front end face of the eleventh rectangular cavity, a front end face of twelfth rectangular cavity and a front end face of the thirteenth rectangular cavity are located on the same plane and are located behind a front end face of the sixth rectangular metal block; the length of the ninth rectangular cavity in the front-back direction is smaller than that of the tenth rectangular cavity in the front-back direction, the length of the tenth rectangular cavity in the front-back direction is smaller than that of the eleventh rectangular cavity in the front-back direction, the length of the ninth rectangular cavity in the front-back direction is equal to that of the thirteenth rectangular cavity in the front-back direction, and the length of the tenth rectangular cavity in the front-back direction is equal to that of the twelfth rectangular cavity in the front-back direction; a rear end face of the eleventh rectangular cavity is located in front of a rear end face of the sixth rectangular metal block, and a second rectangular metal base plate, a third rectangular metal base plate, a fourth rectangular metal base plate, a fifth rectangular metal base plate and a third H-plane step are arranged in the eleventh rectangular cavity; a front end face of the second rectangular metal base plate, a front end face of the third rectangular metal base plate, a front end face of the fourth rectangular metal base plate and a front end face of the fifth rectangular metal base plate are attached to a front end of the eleventh rectangular cavity; a rear end face of the second rectangular metal base plate, a rear end face of the third rectangular metal base plate, a rear end face of the fourth rectangular metal base plate and a rear end face of the fifth rectangular metal base plate are attached to the rear end face of the eleventh rectangular cavity; a length of the second rectangular metal base plate in the left-right direction is smaller than a quarter of a length of the eleventh rectangular cavity in the left-right direction, the length of the second rectangular metal base plate in the left-right direction is equal to that of the third rectangular metal base plate in the left-right direction, a length of the fourth rectangular metal base plate in the left-right direction is equal to that of the fifth rectangular metal base plate in the left-right direction, a length of the fifth rectangular metal base plate in the left-right direction is smaller than one fifth of a length of the third rectangular metal base plate in the left-right direction, a height of the second rectangular metal base plate, a height of the third rectangular metal base plate, a height of the fourth rectangular metal base plate and a height of the fifth rectangular metal base plate are equal and are smaller than one tenth of a height of the eleventh rectangular cavity, a lower end face of the second rectangular metal base plate and a lower end face of the third rectangular metal base plate are attached to the lower end face of the eleventh rectangular cavity, the fourth rectangular metal base plate is attached to an upper surface of the second rectangular metal base plate, a right end face of the fourth rectangular metal base plate is flush with a right end face of the second rectangular metal base plate, the length of the fourth rectangular metal base plate in the left-right direction is smaller than one fifth of the length of the second rectangular metal base plate in the left-right direction, the fifth rectangular metal base plate is attached to an upper surface of the third rectangular metal base plate, a left end face of the fifth rectangular metal base plate is flush with a left end face of the third rectangular metal base plate, the second rectangular metal base plate is located on a left side of a vertical plane where a center line of the eleventh rectangular cavity in the left-right direction is located, a distance from the right end face of the second rectangular metal base plate to the vertical plane where the center line of the eleventh rectangular cavity in the left-right direction is located is half of a width of a standard waveguide port WR-28, the third rectangular base plate is located on a right side of a vertical plate where the center line of the eleventh rectangular cavity in the left-right direction is located, the distance from the left end face of the third rectangular metal base plate to the vertical plane where the center line of the eleventh rectangular cavity in the left-right direction is located is half of the width of the standard waveguide port WR-28, a front end face of the third H-plane step is attached to the front end face of the eleventh rectangular cavity, a rear end face of the third H-plane step is attached to the rear end face of the eleventh rectangular cavity, an upper end face of the third H-plane step is flush with the upper end face of the sixth rectangular metal block, a vertical plane where a center line of the third H-plane step in the left-right direction is located coincides with the vertical plane where the center line of the eleventh rectangular cavity in the left-right direction is located, a width of the third H-plane step in the left-right direction is smaller than that of the standard waveguide port WR-28, and a height of the third H-plane step is smaller than half that of the eleventh rectangular cavity; a first ridge step is arranged in the ninth rectangular cavity, a second ridge step is arranged in the tenth rectangular cavity, a third ridge step and a fourth ridge step are arranged in the eleventh rectangular cavity, a fifth ridge step is arranged in the twelfth rectangular cavity, a sixth ridge step is arranged in the thirteenth rectangular cavity, and the first ridge step, the second ridge step, the third ridge step, the fourth ridge step, the fifth ridge step and the sixth ridge step are all rectangular; a left end face of the first ridge step is flush with the left end face of the ninth rectangular cavity, a right end face of the first ridge step is flush with the right end face of the ninth rectangular cavity, a height of the first ridge step is smaller than that of the ninth rectangular cavity, a length of the first ridge step in the front-back direction is smaller than that of the ninth rectangular cavity in the front-back direction, a distance between a front end face of the first ridge step and the front end face of the ninth rectangular cavity is equal to a distance between a rear end face of the first ridge step and a rear end face of the ninth rectangular cavity, a left end face of the second ridge step is attached to the right end face of the first ridge step, a right end face of the second ridge step is flush with the right end face of the tenth rectangular cavity, a front end face of the second ridge step is flush with the front end face of the first ridge step, a rear end face of the second ridge step is flush with the rear end face of the first ridge step, a height of the second ridge step is smaller than that of the first ridge step, a left end face of the third ridge step is attached to the right end face of the second ridge step, a right end face of the third ridge step is located in the eleventh rectangular cavity, the right end face of the third ridge step is spaced from a left end face of the second rectangular metal base plate by a certain distance which is smaller than the length of the second rectangular metal base plate in the left-right direction, a front end face of the third ridge step is flush with the front end face of the second ridge step, a rear end face of the third ridge step is flush with the rear end face of the second ridge step, a height of the third ridge step is smaller than that of the second ridge step, a right end face of the fourth ridge step is flush with the right end face of the thirteenth rectangular cavity, a left end face of the fourth ridge step is flush with the left end face of the thirteenth rectangular cavity, a height of the fourth ridge step is equal to that of the first ridge step, a length of the fourth ridge step in the front-back direction is equal to that of the first ridge step in the front-back direction, a distance between a front end face of the fourth ridge step and the front end face of the thirteenth rectangular cavity is equal to a distance between a rear end face of the fourth ridge step and a rear end face of the thirteenth rectangular cavity, a right end face of the fifth ridge step is attached and connected to the left end face of the fourth ridge step, a left end face of the fifth ridge step is flush with the left end face of the twelfth rectangular cavity, a front end face of the fifth ridge step is flush with the front end face of the fourth ridge step, a rear end face of the fifth ridge step is flush with the rear end face of the fourth ridge step, a height of the fifth ridge step is equal to that of the second ridge step, a right end face of the sixth ridge step is attached to the left end face of the fifth ridge step, a left end face of the sixth ridge step is located in the eleventh rectangular cavity, the left end face of the sixth ridge step is spaced from a right end face of the third rectangular metal base plate by a certain distance which is smaller than the length of the third rectangular metal base plate in the left-right direction, a front end face of the sixth ridge step is flush with the front end face of the fifth ridge step, a rear end face of the sixth ridge step is flush with the rear end face of the fifth ridge step, a height of the sixth ridge step is equal to that of the third ridge step, a rectangular waveguide input port communicated with the eleventh rectangular cavity is formed in the sixth rectangular metal block, a lower end of the rectangular waveguide input port is located on the lower end face of the sixth rectangular metal block, an upper end of the rectangular waveguide input port is communicated with the lower end face of the eleventh rectangular cavity, a front end face of the rectangular waveguide input port is flush with the front end face of the eleventh rectangular cavity, a rear end face of the rectangular waveguide input port is flush with the rear end face of the eleventh rectangular cavity, a left end face of the rectangular waveguide input port is flush with the right end face of the second rectangular metal base plate, and a right end face of the rectangular waveguide input port is flush with the left end face of the third rectangular metal base plate; a first output port of the E-plane T-type rectangular-single ridge waveguide power divider is formed in the left end face of the ninth rectangular cavity, a second output port of the E-plane T-type rectangular-single ridge waveguide power divider is formed in the right end face of the thirteenth rectangular cavity, and output ports of the E-plane T-type rectangular-single ridge waveguide power divider are in butt joint with the H-plane T-type single-ridge waveguide power divider.

5. The ultra-wideband CTS flat-plate array antenna according to claim 3, wherein the H-plane T-type single-ridge waveguide power divider comprises a seventh rectangular block, wherein a fourteenth rectangular cavity and a fifteenth rectangular cavity are formed in the seventh rectangular metal block, the fourteenth rectangular cavity is communicated with the fifteenth rectangular cavity, a front end face of the fourteenth rectangular cavity is flush with a front end face of the seventh rectangular metal block, a rear end face of the seventh rectangular metal block is flush with the front end face of the seventh rectangular metal block, a left end face of the fifteenth rectangular cavity is flush with a left end face of the seventh rectangular metal block, a right end face of the fifteenth rectangular cavity is flush with a left end face of the fourteenth rectangular cavity, a center line of the fifteenth rectangular cavity in the front-back direction and a center line of the seventh rectangular metal block in the front-back direction are located on the same vertical plane, an upper end face of the fourteenth rectangular cavity and an upper end face of the fifteenth rectangular cavity are flush with an upper end face of the seventh rectangular metal block, and a height of the fourteenth rectangular cavity is equal to that of the fifteenth rectangular cavity; a fifth rectangular metal ridge, a sixth rectangular metal base plate and a sixth rectangular metal ridge are sequentially arranged in the fourteenth rectangular cavity from front to back; a front end face of the fifth rectangular metal ridge is flush with the front end face of the fourteenth rectangular cavity, a rear end face of the fifth rectangular metal ridge is flush with a front end face of the fifteenth rectangular cavity, a rear end face of the sixth rectangular metal ridge is flush with a rear end face of the fourteenth rectangular cavity, a front end face of the sixth rectangular metal ridge is flush with a rear end face of the fifteenth rectangular cavity, a height of the fifth rectangular metal ridge is equal to that of the sixth rectangular metal ridge and is equal to half that of the fourteenth rectangular cavity, a length of the fifth rectangular metal ridge in the left-right direction is equal to that of the sixth rectangular metal ridge in the left-right direction, the length of the fifth rectangular metal ridge in the left-right direction is smaller than a quarter of a length of the fourteenth rectangular cavity in the left-right direction, a left end face of the fifth rectangular metal ridge is flush with a left end face of the sixth rectangular metal ridge, a right end face of the fifth rectangular metal ridge is flush with a right end face of the sixth rectangular metal ridge, a front end face of the sixth rectangular metal base plate makes contact with the rear end face of the fifth rectangular metal ridge, a rear end face of the sixth rectangular metal base plate makes contact with the front end face of the sixth rectangular metal ridge, a left end face of the sixth rectangular metal base plate is flush with the left end face of the fourteenth rectangular cavity, a right end face of the sixth rectangular metal base plate is flush with a right end face of the fourteenth rectangular cavity, a height of the sixth rectangular metal base plate is smaller than a quarter of the height of the fourteenth rectangular cavity, a seventh rectangular metal ridge is arranged in the fifteenth rectangular cavity, a left end face of the seventh rectangular metal ridge is flush with the left end face of the fifteenth rectangular cavity, a right end face of the seventh rectangular metal ridge makes contact with the left end face of the sixth rectangular metal base plate, a length of the seventh rectangular metal ridge in the front-back direction is equal to that of the fifth rectangular metal ridge in the left-right direction, a distance between a front end face of the seventh rectangular meal ridge and the front end face of the fifteenth rectangular cavity is equal to a distance between a rear end face of the seventh rectangular metal ridge and the rear end face of the fifteenth rectangular cavity, a length of the fifteenth rectangular cavity in the left-right direction is equal to that of the ninth rectangular cavity in the front-back direction, the left end face of the fifteenth rectangular cavity in the H-plane T-type single-ridge waveguide power divider is in butt joint with output ports of the E-plane T-type rectangular-single ridge waveguide power divider, and the left end face and the right end face of the fourteenth rectangular cavity in the H-plane T-type single-ridge waveguide power divider are in butt joint with corresponding single ridge waveguide-rectangular waveguide converters.

6. The ultra-wideband CTS flat-plate array antenna according to claim 3, wherein the single ridge waveguide-rectangular waveguide converter comprises an eighth rectangular metal block, a sixteenth rectangular cavity is formed in the eighth rectangular metal block, a first E-plane step is arranged on a left side of the sixteenth rectangular cavity and is rectangular, a height of the first E-plane step is smaller than that of the sixteenth rectangular cavity, the first E-plane step is connected with a front end face, a rear end face and a left end face of the sixteenth rectangular cavity, a fourth H-plane step is arranged on a right side of the sixteenth rectangular cavity and is connected with a right end face and the rear end face of the sixteenth rectangular cavity, a height of the fourth H-plane step is equal to that of the sixteenth rectangular cavity, a rectangular waveguide output port communicated with the sixteenth rectangular cavity is formed in an upper surface of the eighth rectangular metal block, a single-ridge waveguide input port is formed in a front side face of the eighth rectangular metal block and is communicated with the sixteenth rectangular cavity, a height of the single-ridge waveguide input port is equal to that of the sixteenth rectangular cavity, a bottom surface of the single-ridge waveguide input port and a bottom surface of the sixteenth rectangular cavity are located on the same plane, a first ridge step extending onto the bottom surface of the sixteenth rectangular cavity is arranged on the bottom surface of the single-ridge waveguide input port, and comprises a first rectangular ridge and a second rectangular ridge which are sequentially connected, a height of the first rectangular ridge is greater than that of the second rectangular ridge, the height of the first rectangular ridge is smaller than that of the sixteenth rectangular cavity, a size of the single-ridge waveguide input port is matched with that of a left end face of the fourteenth rectangular cavity in the H-plane T-type single-ridge waveguide power divider, the single-ridge waveguide input port is in butt joint with the left end face or a right end face of the fourteenth rectangular cavity in the H-plane T-type single-ridge waveguide power divider.

* * * * *